US007350327B1

(12) United States Patent
Logan et al.

(10) Patent No.: US 7,350,327 B1
(45) Date of Patent: Apr. 1, 2008

(54) MOUNTING DEVICES FOR EXIT SIGNS AND OTHER FIXTURES

(75) Inventors: Mark Logan, Atlanta, GA (US); Paul Kenneth Pickard, Conyers, GA (US)

(73) Assignee: ABL IP Holding, LLC, Conyers, GA (US)

( * ) Notice: Subject to any disclaimer, the term of this patent is extended or adjusted under 35 U.S.C. 154(b) by 337 days.

(21) Appl. No.: 10/763,035

(22) Filed: Jan. 22, 2004

(51) Int. Cl.
*G09F 13/04* (2006.01)

(52) U.S. Cl. ..... 40/570; 439/537

(58) Field of Classification Search ..... 40/570, 40/564, 568, 572; 248/343–344, 222.41, 248/222.51, 222.52; 362/812, 370
See application file for complete search history.

(56) References Cited

U.S. PATENT DOCUMENTS

| | | | | |
|---|---|---|---|---|
| 3,402,494 | A * | 9/1968 | Gray | 40/570 |
| 3,478,455 | A | 11/1969 | Fremont | |
| 3,665,626 | A | 5/1972 | Lund et al. | |
| 3,772,527 | A | 11/1973 | Darling et al. | |
| 3,924,344 | A | 12/1975 | Davis | |
| 3,931,689 | A | 1/1976 | Shine | |
| 4,071,749 | A | 1/1978 | Balogh | |
| 4,162,779 | A * | 7/1979 | Van Steenhoven et al. | 248/343 |
| 4,222,093 | A | 9/1980 | Garcia | |
| 4,255,746 | A * | 3/1981 | Johnson et al. | 340/577 |
| 4,355,479 | A | 10/1982 | Thornton | |
| 4,449,168 | A * | 5/1984 | Ewing | 362/404 |
| 4,466,208 | A | 8/1984 | Logan, Jr. et al. | |
| 4,561,203 | A | 12/1985 | MacDonald, Jr. et al. | |
| 4,600,972 | A * | 7/1986 | MacIntyre | 362/20 |
| 5,018,290 | A | 5/1991 | Kozek et al. | |
| 5,174,642 | A * | 12/1992 | Brohard et al. | 362/20 |
| 5,247,756 | A | 9/1993 | Johnstone | |
| 5,272,605 | A * | 12/1993 | Johnstone | 362/147 |
| 5,376,020 | A * | 12/1994 | Jones | 439/537 |
| 5,461,550 | A | 10/1995 | Johnstone | |
| 5,526,251 | A * | 6/1996 | Andre et al. | 362/396 |
| D379,373 | S | 5/1997 | Logan et al. | |
| 5,727,867 | A | 3/1998 | Johnstone | |
| 5,735,498 | A | 4/1998 | Jue et al. | |
| 5,768,814 | A * | 6/1998 | Kozek et al. | 40/570 |

(Continued)

FOREIGN PATENT DOCUMENTS

EP 0412281 A1 2/1991

OTHER PUBLICATIONS

Brochure, "Kast Exits—Stencil or Plastic Face," Incandescent Catalog, Lithonia Lighting, Inc. (1965), p. 26.

(Continued)

*Primary Examiner*—Cassandra Davis
(74) *Attorney, Agent, or Firm*—Kilpatrick Stockton, LLP

(57) ABSTRACT

Canopy mounting devices that cover junction boxes of various configurations and provide a pleasing, finished appearance to a resulting installation are disclosed. Certain embodiments of a canopy mounting device include a universal mounting plate integrally formed with a connector of the mounting device such that direct mounting to junction boxes of different configurations is possible. The mounting devices accommodate not only appropriate mountings of junction boxes within ceilings or walls but also inappropriate mountings, such as when junction boxes are recessed too deeply within a ceiling or wall or mounted with junction box edges extending outwardly from the ceiling or wall.

25 Claims, 16 Drawing Sheets

U.S. PATENT DOCUMENTS

| | | | | |
|---|---|---|---|---|
| 5,797,673 | A | 8/1998 | Logan et al. | |
| 5,988,825 | A | 11/1999 | Masters et al. | |
| 6,082,031 | A | 7/2000 | Heaton et al. | |
| 6,142,648 | A | 11/2000 | Logan et al. | |
| 6,241,369 | B1 * | 6/2001 | Mackiewicz | 362/368 |
| 2006/0278766 | A1 * | 12/2006 | Wang | 248/74.1 |

OTHER PUBLICATIONS

Brochure, "Fail-Safe Exit Sign," Lithonia Lighting (1971).
Brochure, "Exit Series—Plastic Face," Lithonia Lighting (1971), p. 64.
Brochure, "ES/EP Premiun Exits," Lithonia (1980), p. 52.
Brochure, "AS/AP Incandescent Series," Lithonia Emergency Lighting, p. 24 (1984).
Installation Instructions, "Spectrum Series Model MS/MP 120/277 Exit Signs," Lithonia Emergency Systems (Jul. 28, 1986).
Drawing, "L.A. Swivel Male" (Jul. 7, 1986).
One page of photographs, Lithonia Lighting Systems Emergency Exit Sign with Chevrons as shown in Brochure, "Introducing the New QM-EL Quantum Emergency Exit Sign," Lithonia Lighting (1992) listed above (Chevron Sign).
One page of photographs, Model KSR-LED EZ Snap Series Exit Sign, Dual Lite (Oct. 26, 1994) ("Dual Lite Sign") as shown in Installation Instructions, EZ Snap LED Exit Signs, Dual-Lite (Jul. 1994) listed above.
One page of photographs (Cam Attachment (Long)) shown in Drawing, "Pin, Locking, Pedestal Swivel" (Mar. 30, 1989) and Brochure, Installation Instructions Titan Series (Circa 1989), listed above.
One page of photographs (Cam Attachment (Short)) shown in Drawing, "Swivel, Lamp Par36" (Oct. 5, 1993) listed above.
Photograph of Swivel shown in Drawing, "L.A. Swivel Male" (Jul. 7, 1986) listed above.
One page of photographs, canopy/blackplate shown in Brochure, "Dual-Lite Excite™ Simply Beauitful," Dual-Lite, Inc. (Jul. 1980) listed above.
One page of photographs, canopy housing shown in Brochure, "Introducing the Quantum Difference," Lithonia Emergency Systems (1989) listed above.
Brochure, "6 Volt Self-Powered Economy Exit Light—Series EP," Elau Lighting Products Division of Altus Corporation (Apr. 1982).
Brochure, "6 Volt Combination Emergency Light/Exit Sign—Series ED," Elan Lighting Products Division of Altus Corporation (Apr. 1982).
Brochure, "Standard and AC-DC Exit Signs—Series WX & BX," Elan Lighting Products Division of Altus Corporation (Sep. 1982).
Brochure, "Chloride . . . the quality innovators—Signout Self-Powered AC/DC exit signs," Chloride Systems (Sep. 1982).
Brochure, "Universal Module Exit Signs—XU Series, AC or AC/DC," Teledyne Big Beam (Mar. 1989).
Brochure, "Universal Module Exit Signs—XU Series, AC or AC/DC," Teledyne Big Beam (Aug. 1990).
Brochure, "Dynaray Emergency Lighting—81 Series," Electro Powerpacs Corp. (Jun. 1990).
Brochure, "The New Siltron UX Series—Extruded Aluminum Sealed Maintenance-Free Nickel Cadmium Batteries," Siltron Illumination, Inc. (undated).
Brochure, "Fluorescent Emergency Light Power Pack—CFP Series," Chloride Systems (undated), pp. 11-18.
Brochure, "Chloride . . . Life Safety Products & Systems—Total Flexibility in a Single Exit Sign," Chloride Systems (undated).
Linn, Charles, A 1 A, "From 'Frog Eyes on a Lunch Box' to Subtle, Quality Emergency Fixtures," *Lighting Update, Facilities Design & Management* (undated), p. 47.
Installation Instructions, "EZ-Snap LED Exit Signs," Dual-Lite (Jul. 1994).
Drawing, "Pin, Locking, Pedestal Swivel" (Mar. 30, 1989).
Brochure, "Installation Instructions Tital Series" (Circa 1989).
Drawing, "Swivel, Lamp Far 36" (Oct. 5, 1993).
Brochure, "Spectrum Series—Contemporary Injection Molded Emergency Exit Signs," Lithonia Emergency Systems (1987).
Brochure, Spectrum Series—Emergency Exit, Lithonia Emergency Systems (1987).
Brochure, "Introducing the Quantum Difference," Lithonia Emergency Systems (1989).
Brochure, "FAS/FAP Fluorescent Series," Lithonia Emergency Lighting (undated), p. 25.
Brochure, "Introducing the New QM-EL Quantum Emergency Exit Sign," Lithonia Lighting (1992).
Brochure, "Your Choice of Exit Signs Can Make a World of Difference," Lithonia Lighting (1993).
Quantum® Installation Instructions, QM-EL Emergency Exit Signs, Lithonia Emergency Systems (undated).
Installation Instructions Supplement, Hardware: Side Mount & Top Mount Models: M 120/277 Exit Signs, Lithonia Emergency Systems (undated).
Brochure, "Dual-Lite EXITE™ Simply Beautiful," Dual-Lite, Inc. (Jul. 1980).
Brochure, "Excalibur® Series," Dual-Lite (undated).
Brochure, Excite™ Series, Dual Lite (Mar. 1988).
Brochure, EZ-Snap™ Series, Dual-Lite (Sep. 1990).
Installation Instructions, "Dual-Lite EX-SNAP® Exit Signs" (Jan. 1994).
Brochure, "Single and Dual Lamp Fluorescent AC and Emergency Universal Mounting Exit Signs" (Undated), pp. 27-28.
Form F1.2, Exit Directional: Edge-Glo® Exit, Fluorescent RGLO/SGLO-FL Series, ALKCO, A Division of JJL Lighting Group, Inc. (Jun. 2003).
Form F1.3, Exit Directional: Edge-Glo® Exit, LED RGLO/SGLO-LED Series, ALKCO, A Division of JJL Lighting Group, Inc. (Jun. 2003).
Form F1.4, Exit Directional: Edge-Glo® Exit, Wall Recessed LED WGLO-LED Series, ALKCO, A Division of JJL Lighting Group, Inc. (Feb. 2003).
Form F1.0, Exit Directional: Edge-Glo® Exit, Edge-Glo® Exit, RPC/CP Series, AKLCO, A Division of JJL Lighting Group, Inc.
Form F3.3, Exit Directional Signage/Exit: Extruded Aluminum AAPA/ABP-APA Series, ALKCO, A Diviaion of JJL Lighting Group, Inc.
Form F3.4, Exit Directional Signage/Exit: Extruded Aluminun AGRA Battery Series, ALKCO, A Division of JJL Lighting Group, Inc.
Form F3.6, Exit Directional Signage/Exit: LED Exit, Cast Aluminum Sign, ALKCO, A Division of JJL Lighting Group, Inc.
Model CA: Model CA Cast Aluminum LED Exit Sign, Architectural Series, Astralite Inc.
Model EEU-2: EEU-2 Exit Emergency Combo, Commercial Series, Astralite, Inc.
Model EEU2: EEU-2-16 Remote Capable Exit Emergency Combo, Commercial Series, Astralite, Inc.
Model EEU-2: EEU-2-32 Remote Capable Exit Emergency Combo, Commercial Series, Astralite, Inc.
Model ELX8: 8 Inch LED Edge Lit Exit, Metro Series, Commercial Series, Astralite, Inc.
Model ELX: LED Edge Lit Exit (Rescessed Mount), Precision Series, Astralite, Inc.
Model ELX: LED Edge Lit Exit (Surface Mount), Architectural Series, Astralite, Inc.
Model GLNY: Galvanized 8" LED Exit Sign NYC Approved, Metro Series, Astralite, Inc.
Model NY: New York City Approved 8 Inch LED Exit Sign Combo, Value Series, Astralite, Inc.
Model EANY: New York City Approved 8 Inch LED Exit Sign, Metro Series, Astralite, Inc.
Model ST-GAL: 6 Inch Galvanized Steel Exit Sign, Designer Series, Astralite, Inc.
Model TP: Thermo Plastic LED Exit, Commercial Series, Astralite, Inc.
Symmetry II Series, Thermoplastic Combination Emergency Exits, High Performace, Adjustable Lamp Reflector Systems LED Illumination, Chloride Systems, A Division of Genlyt Thomas Group LLC (May 2001).

Symmetry I Series, Commercial Grade Thermoplastic LED Exits AC Only and Emergency Operation LED Illumination, Chloride Systems, A Division of Genlyt Thomas Group LLC (Sep. 2002).
Symmetry I Series, Thermoplastic Combination Emergency Exits, High Performance, Adjustable Lamp Reflector Systems LED Illumination, Chloride Systems, and 6V 12-25 Watt Installation and Operating Instructions, A Division of Genlyt Thomas Group LLC (Sep. 2002).
Symmetry Series, Edge-Lit Exits AC Only and Emergency Operation LED Illumination, Chloride Systems and 120VAC or 277VAC LED Edgelit Exit Fixture Installation and Operating Instructions, A Division of Genlyt Thomas Group LLC (Sep. 2002).
CX Series, Specification Grade Die Cast Aluminum Exits AC Only and Emergency Operation LED Illumination, Chloride Systems and 120VAC Emergency LED Cast Exit Single or Double Face Installation and Operating Instructions, A Division of Genlyt Thomas Group LLC (Sep. 2002).
Reference Series II, Wet Location, Vandal Resistant Heavy Duty Die Cast LED Exit AC Only and Emergency Operation and 120VAC/277VAC Emergency LED Exit Suitable for Wet Location Single or Double Face Installation and Operating Instructions, Chloride Systems, A Division of Genlyt Thomas Group LLC (May 2001).
Reference Series II, Fully Recessed Die Cast Aluminum Exits AC Only and Emergency Operation LED Illumination, Chloride Systems and 120VAC/277VAC Emergency Recessed Led Exit Installation and Operating Instructions, A Division of Genlyt Thomas Group LLC (May 2001).
Sterling Series, Edge-Lit LED Exits AC Only and Emergency Operation LED Illumination, Chloride Systems and 120/277VAC AC Recessed LED Edgelit Exit Installation and Operating Instructions, A Division of Genlyt Thomas Group LLC (Sep. 2002).
STELX Series by Chloride Systems, Emergency Recessed LED Edgelit Exit, Installation and Operating Instructions, Rev. 1.
STELX Series by Chloride Systems, Surface Mount Emergency LED Edgelit Exit, Installation and Operation Instructions, Rev. 2.
Excel Series, Heavy Duty Steel LED Exits AC Only and Emergency Operation LED Illumination, Chloride Systems, A Division of Genlyt Thomas Group LLC (May 2001).
XLA Series Steel LED Exit by Chloride Systems, AC LED Exit 120/277VAC, Installation and Operating Instructions, Rev. 1.
XLN Series Steel LED Exit by Chloride Systems, Emergency LED Exit Sign, Installation and Operating Instructions, Rev. 2.
XL Series Steel LED Exit by Chloride Systems, 2 Headed Emergency LED Exit Sign, Installation and Operating Instructions, Rev. 1.
Symmetry SLA Series by Chloride Systems, 120V or 227V AC Plastic LED Exit Installation and Operating Instructions, Rev. 1.
Symmetry SLN Series by Chloride Systems, 120 or 277VAC Self Powered Plastic LED Exit Installation and Operating Instructions, Rev. 1.
120V or 277V Self Powered/AC Plastic LED Exit Installation and Operating Instructions.
6 Volt Emergency Lighting Combo Unit with 2-5.4W Lamps Installation and Operating Instructions, Rev. 4.
Excel Series, Heavy Duty Steel Combination Exit/Emergency Units, Emergency Operation with Side-Mounted Lamp Heads LED Illumination, Chloride Systems, A Division of Genlyt Thomas Group LLC (May 2001).
Infinity II Series, Semi-Recessed Exits AC Only and Emergency Operation LED Illumination, Chloride Systems, A Division of Genlyt Thomas Group LLC (May 2001); LAC Semi-Recessed AC Exit Sign by Chloride Systems, Suitable for Floor Proximity Installation, Installation and Operating Instructions, Rev. 2.
Self-Luminous Series, Tritium Exits, Operates Without External Power Source 10, 15 or 20 Year Life, Chloride Systems, A Division of Genlyt Thomas Group LLC (May 2001).
Installation and Instructions for AC L.E.D. Exit Signs, CX Series, Sure-Lites, Cooper Lighting (Mar. 1998).
Installation Instructions for Self Powered Self-Diagnostic L.E.D. Exit Signs CX Series, Sure-Lites, Cooper Lighting (Mar. 2000).
Installation Instructions For CAX—L.E.D. AC and If Powered Exit Signs, Sure-Lites, Cooper Lighting (Jul. 1998).
Installation Instructions for Self Powered Exit Signs CAX Series, Sure-Lites, Cooper Lighting (Apr. 1999).
Installation Instructions For CAX—L.E.D. Self-Diagnostic Self Powered Exit Signs, Sure-Lites, Cooper Lighting (May 2000).
Installation Instructions for Self-Powered Exit Signs CAX Series With LED Lite-Stx™, Sure-Lites Cooper Lighting (Apr. 1997).
Instruction Sheet for TPX-L.E.D. AC and Self-Powered Exit Signs, Sure-Lites, Cooper Lighting.
Instruction Sheet for Remote TPX, Sure-Lites, Cooper Lighting.
Installation Instructions for HZX Series Explosion Proof Exit Signs, Sure-Lites, Cooper Lighting.
Installation Instructions for AC L.E.D. Exit Signs CCX Series, Sure-Lites, Cooper Lighting (Jun. 1998).
Installation Instructions for AC Incandescent Exit Signs CCX Series, Sure-Lites, Cooper Lighting (Jun. 1998)).
Installation Instructions EEX Series L.E.D. Edge Lit Exit Signs for AC Wall, Ceiling and End Mount, Sure-Lites. Cooper Lighting (Apr. 1998).
Installation Instructions EEX Series L.E.D. Edge Lit Exit Signs For Self-Powered Wall, Ceiling and End Mount, Sure-Lites, Cooper Lighting (Apr. 1998).
Installation Instructions For AC EAX/EAC Exit Signs, Sure-Lites, Cooper Lighting (Jul. 1998).
Installation Instructions for Self Powered Exit Signs, Sure-Lites, Cooper Lighting.
Installation Instructiopns For Self Powered LED Exit Signs, Sure-Lites, Cooper Lighting (Aug. 1994).
Installation Instructions for AC Powered Led Exit Signs, Sure-Lites, Cooper Lighting (Jun. 1994).
Installation Instructions for AC Incandescent INCX Series Exit Signs and Technical Data, Sure-Lites, Cooper Lighting.
Installation Instructions- SLX Series L.E.D. Exit Signs for AC and Self-Powered, Wall, Ceiling and End Mount, Sure-Lites, Cooper Lighting (Dec. 1998).
Installation Instructions for UX EXIT Series, LED, Self Powered, Self-Diagnostic Universal Mounting, Wall, Ceiling, and End Mount Convertible to 2 Face Exit—with optional UXUK KIT, Sure-Lites, Cooper Lighting (Sep. 2003).
Installation Instructions for UX EXIT Series, LED, AC Only, -2C Option for 2 Circuits Universal Mounting, Wall, Ceiling, and End Mount Convertible to 2 Face Exit—with Optional UXUK KIT, Sure-Lites, Cooper Lighting (Sep. 2003).
Installation Instructions for UXUK Universal 2 Face Conversion Kit For Ceiling Canopy or End Mounting Canopy—UX Exit Sign Series, Sure-Lites, Cooper Lighting (Sep. 2003).
Installation Instructions for UX Exit Series-HAZ for Hazardous Locations, Class I, Div. 2, Groups A,B,C,D, Sure-Lites, Cooper Lighting (Sep. 2003).
Installation Instructions for HZX Series Explosion Proof Exit Signs, Sure-Lites.
120VAC or 277VAC AC LED Cast Exit Single or Double Face, Installation and Operating Instructions Rev.0.
120VAC/277VAC Emergency LED Cast Exit Single or Double Fact, Installation and Operating Instructions Rev.0.
120VAC/277VAC Emergency LED Cast Exit with Self-Diagnostics Single or Double Face, Installation and Operating Instructions Rev.0.
E800 Series Cast LED Exit by LightGuard, 120VAC or 277VAC AC LED Exit Single or Double Face Suitable for Wet Location Installation and Operating Instructions Rev.0.
E803 Series Cast LED Exit by LightGuard, 120VAC/277VAC Emergency LED Exit Suitable for Wet Location Single or Double Face, Installation and Operating Instructions, Rev.0.
NX Series, NEMA, Exit Signs, Technical Data, LightGuard, a Division of Gentyl Thomas Group, LLC (Oct. 1998).
SLDLX Series by LightGuard, 120/277 VAC AC Recessed Led Edgelit Exit, Installation and Operating Instructions, Rev.0.
SLDLX Series by LightGuard, 120/277VAC Surface Mount LED Edgelit Exit, Installation and Operating Instructions, Rev.0.
SLELX Series by LightGuard, Emergency Recessed LED Edgelit Exit, Installation and Operating Instructions, Rev.1.
SLELX Series by LightGuard, Surface Mount Emergency LED Edgelit Exit, Installation and Operating Instructions, Rev. 2.

E100 II Series Heavy Duty Steel Exit Signs, LightGuard A Division of Gentyl Thomas Group LLC (Mar. 2001).
E700 Series, LightGuard A Division of Gentyl Thomas Group LLC, and E700 Semi-Recessed AC Exit Sign by LightGuard, Suitable for Floor Proximity Installation, Installation and Operating Instructions (Mar. 2001).
E1L Series Steel LED Exit by LightGuard, AC LED Exit 120/277VAC. Installation and Operating Instructions Rev.2.
E1LH Series Steel LED Exit by LightGuard, 2 Headed Emergency LED Exit Sign, Installation and Operating Instructions Rev.1.
E1L3 Series Steel LED Exit by LightGuard, Emergency LED Exit Sign, Installation and Operating Instructions, Rev.2.
Sempra™ Series, Compact, low-profile exit signs featuring east aluminum construction, easy installation and energy-saving, long-life LED lamps and installation and operating instructions, Dual-Lite Hubbell Lighting. Inc. (Jul. 2003).
Sempra™ MR Series Compact low-profile Master/Remote exit sign sets featuring east aluminum construction, easy installation and energy-saving, long-life LED lamps and installation and operating instructions, Dual-Lite Bubbell Lighting, Inc. (Jul. 2003).
Sempra™ Series Cast aluminum exit signs for severe condition applications featuring easy installation and energy-saving, long-life LED lamps and installation and operating instructions, Dual-Lite Hubbell Lighting, Inc. (Jul. 2003).
Freedom LED Series Extended Discharge LED Exit Signs, Specifications, Dual-Lite Hubbell Lighting, Inc.
Installation/Owners Manual for Models: LED1EM, LED2EM, LED1AC, LED2AC, PLED1EM, PLED2EM, PLED1AC, PLED2AC, Dual-Lite, Hubbell Lighting, Inc.
LEDS Series, Low Profile, Easy to Install Aluminum Exit Signs Featuring Energy-Saving, Long-Life LED Lamps Specifications, Dual-Lite, Hubble Lighting, Inc. (Jul. 2003).
Installation/Owners Manual for Models PLEDS1EM, PLEDS2EM, PLEDSUEM, PLEDS1AC, PLEDS2AC, PLEDSUAC, LEDS1EM, LEDS2EM, LEDSUEM, LEDS1AC, LEDS2AC and LEDSUAC, Dual-Lite Hubbell Lighting, Inc.
LX Series Low-Profile, Easy to install exit signs featuring energy-saving, long-life led lamps, Specifications and Installation Instructions, Liteforms Collection, Dual-Lite Hubbell Lighting, Inc. (Jul. 2003).
DK Series, AC-Only Incandescent Exit Signs, Specifications, Dual-Lite Hubbell Lighting, Inc. (Jul. 2003).
LT Series, Low-Profile, Easy to install emergency lighting unit/exit signs combinations featuring energy-saving, long-life led lamps Specifications and Installation Instructions, Liteforms Collection Dual-Lite Hubbell Lighting, Inc. (Jul. 2003).
LE Series, Architectural Edge-lit exit signs featuring elegant styling, easy installation and energy-saving, long-life Ied lamps, Specifications and Installation Instructions, Liteforms Collection Dual-Lite Hubbell Lighting, Inc. (Jul. 2003).
LES Series, Architectural AC-only Edge-lit exit signs featuring elegant styling, easy installation and energy saving, long-life led lamps, Specifications and Installation Instructions, Liteforms Collection Dual-Lite Hubbell Lighting, Inc. (Jul. 2003).
LN4X Series, Wet Location UL 50 type 4X exit signs for Indoor/outdoor use, featuring energy-saving, long-life LED lamp assemblies, Specifications and Installation Instructions, Liteforms Collection Dual-Lite Hubbell Lighting, Inc. (Jul. 2003).
EZ-SNAP® Series, Attractive, easy to install exit signs featuring kit based flexibility, Specifications and installation instructions, Dual-Lite (Nov. 1994).
EZ-SNAP® LED LiteCell™ Series, attractive, easy to install exit signs featuring energy saving, long life LED lamp panels, Dual-lite (Nov. 1994).
EZ-SNAP® LED LiteLoop™ Series, Attractive, easy to install exit signs featuring energy saving, long-life LED lamps and kit based flexibility (Sep. 1994).
NV3 Series Thermoplastic LED Exit AC and Emergency Models, Prescolite Life Safety Products Specifications and Installation Instructions, Hubbell Lighting, Inc. (Jul. 2003).
DuraMax™ MR Series Diecast Aluminum LED Exit Signs AC and emergency models with lifetime warranty and standard self-test/self-diagnostic operation, Prescolite Life Safety Products, Hubbell Lighting, Inc. (Jul. 2003).
Cast Aluminum LED Exit Signs Installation and Instructions; Dual-Lite Prescolite Life Safety Products (Oct. 2000).
DuraMax™ MR Series Diecast Aluminum Master/Remote LED Exit Sets For over-door and low level installations, Specifications and Installation Instructions Prescolite Life Safety Products Hubbell Lighting, Inc. (Jul. 2003).
EverGard™ Series Cast Aluminum LED Exit Signs For Severe Conditions, Compast, low-profile exit signs designed specifically for damp, hot, cold or high abuse applications, Specifications and Installation Instructions, Prescolite Life Safety Products Hubbell Lighting, Inc. (Jul. 2003).
GC Series Diecast Aluminum LED Exit Signs AC and emergency models with long life LED lamps, Specifications and Installation Instructions Prescolite Life Safety Products Hubbell Lighting, Inc. (Jul. 2003).
Freedom PLED Series Aluminum LED Exit Signs AC and extended discharge emergency models with long-life LED lamps Specifications, Prescolite Life Safety Products Hubbell Lighting, Inc. (Nov. 2003).
Installation/Owners Manual for Models: LED1EM, LED2EM, LED1AC, LED2AC, PLED1EM, PLED2EM, PLED1AC, PLED2AC, Dual-Lite Prescolite Life Safety Products Hubbell Lighting, Inc.
PLEDS Series Aluminum LED Exit Signs Low-profile AC and emergency models with long-life LED lamps, Specifications, Installation /Owners Manual Prescolite Life Safety Products Hubbell Lighting, Inc. (Jul. 2003).
LEP Series Edge-Lit LED Exit Recessed Mount AC and Emergency Models, Specifications and Installation/Owners Manual, Prescolite Life Safety Products Hubbell Lighting, Inc. (Jul. 2003).
LEPS Series Edge-Lit LED Exit Surface Mount AC Models, Prescolite Life Safety Products Hubbell Lighting, Inc. (Jul. 2003).
LN4XP Series Wet Location LED Edit Surface Mount AC and Emergency Models, Specifications and Installation Instructions, Prescolite Life Safety Products Hubbell Lighting, Inc. (Jul. 2003).
PEXHL Series Combination LED Exit and Emergency Light, Specifications, Prescolite Life Safety Products Hubbell Lighting, Inc. (Jul. 2003).
Exit Lite Series Modular Incaudescent Exit AC and Emergency Models, Specifications, Prescolite Life Safety Products Hubbell Lighting, Inc. (Jul. 2003).
Drawing—Brackets Single Face Plastic Sign (May 1991).
Drawing—Brackets Double Face Plastic Sign.
Drawing—Brackets Single Face Aluminum Sign (May 1991).
Drawing—Brackets Double Face Aluminum Sign (May 1991).
Model SCR-525 EXSC Exit Sign and Specifications, Hobby & Brown Electronic Corporation.

* cited by examiner

MOUNTING DEVICES FOR EXIT SIGNS AND OTHER FIXTURES

FIELD OF THE INVENTION

The invention relates generally to canopy mounting devices for mounting an illuminated sign or the like to a junction box in a ceiling or wall and, more particularly, to canopy mounting devices having universal mounting plate elements formed integrally with portions of the mounting devices to permit rapid installation of visually appealing sign/canopy combinations.

BACKGROUND OF THE INVENTION

A mounting device connects an illuminated sign, such as an exit sign, combination emergency lighting/exit sign fixture, and the like, to a junction box so that electrical wiring from the junction box can be pulled through the mounting device and into the interior of the sign for connection of electrical components therein to a source of mains power. Junction boxes are typically recessed within or otherwise mounted to ceilings or walls. Existing mounting devices typically include a canopy that shields the junction box and also provides a pleasing appearance to the finished installation.

One existing canopy mounting device utilizes a camming element that biases a sign housing and a canopy element of the mounting device together in order to provide a secure connection of the sign to a junction box through the canopy mounting device. Another existing canopy mounting device includes resilient spring fingers formed on a canopy element that covers a junction box. The spring fingers are inserted through an opening in a sign housing to snap-fit to the housing. Yet another existing canopy mounting device includes a canopy element having a post received within a slot of a sign housing. The slot has portions of varying width such that the post of the canopy element is inserted into a wide portion of the slot and then moved into a more narrow portion to be locked in place. Another existing canopy mounting device includes a canopy element with a projecting bracket that is received within a slot in a side or top of a sign housing. Screws are then used to connect the sign housing to the canopy element.

Because exit signs and the like are mandated in environmental spaces such as commercial buildings, it is often necessary to install large numbers of such signs at a given job site. Thus, it is important that each sign installation is completed quickly and easily, with a reliable connection of the junction box and the exit sign through the canopy mounting device. In addition to minimizing installation time, effort, and expense, it is also desirable to be able to install exit signs without the need for special or unusual tools. Accordingly, there is a need for canopy mounting devices that may be connected to junction boxes more quickly, easily, and reliably, and preferably without the use of special tools.

SUMMARY OF THE INVENTION

The present invention provides canopy mounting devices that cover junction boxes of various configurations and provide a pleasing, finished appearance to a resulting installation.

Canopy mounting devices of this invention provide reliable mounting of exit signs and the like to junction boxes disposed in or on ceilings or walls and may be installed without requiring special tools. Certain embodiments of a canopy mounting device include a universal mounting plate integrally formed with a connector of the mounting device such that direct mounting to junction boxes of different configurations is possible. Screws or other fasteners that connect the junction box to the sign housing through the universal mounting plate element are covered by outer portions of a canopy element of the mounting device in a finished installation such that the screws and fasteners are not visible. Additionally, certain embodiments may include structure capable of accommodating not only appropriate mountings of junction boxes within ceilings or walls but also inappropriate mountings, such as when junction boxes are recessed too deeply within a ceiling or wall or mounted with junction box edges extending outwardly from the ceiling or wall.

In one embodiment, a mounting device for connecting an electrical fixture to a junction box that is mounted to a wall or ceiling surface includes a canopy element that covers the junction box upon connection of the mounting device to the junction box, a connector that connects to the electrical fixture and is disposed between the canopy element and the junction box, and a universal mounting plate integrally formed with the connector that connects to the junction box. The electrical fixture may be an exit sign, and the junction box may be mounted flush with the wall or ceiling surface, completely recessed within the wall or ceiling, or one or more edges of the junction box may extend outside the wall or ceiling surface.

In certain embodiments, a universal mounting plate includes a plurality of apertures patterned to correspond to apertures in a junction box. The mounting device may include at least one fastener that extends through at least one of the plurality of apertures in the universal mounting plate and a corresponding aperture in the junction box. The at least one fastener connects the junction box and the universal mounting plate without engaging or passing through the canopy element. The at least one fastener may be two screws.

In certain embodiments, a connector of the mounting device includes a plurality of circumferential ridges, and a canopy element of the mounting device includes an opening and is positionable relative to the wall or ceiling surface by engagement between a peripheral edge of the opening of the canopy element and any one of the plurality of circumferential ridges of the connector. Alternatively, the connector may include flexible tabs that bias against opposing surfaces of the electrical fixture upon attachment of the electrical fixture to the connector to position the canopy element flush against the wall or ceiling surface.

In certain embodiments, the connector of the mounting device has a plurality of radial ridges disposed about a surface of the connector that mates with the electrical fixture. The plurality of radial ridges engage corresponding ridges disposed on a surface about the periphery of an opening in the electrical fixture to prevent displacement of the electrical fixture relative to the mounting device. In other embodiments, the connector may include a plurality of torsion hooks that extend into an opening in the electrical fixture and engage surfaces of the electrical fixture adjacent the opening.

In certain embodiments, the connector of the mounting device includes at least one hook receivable within an opening in the electrical fixture. The mounting device also includes a locking pin with a camming surface that engages with a surface of the at least one hook of the connector to secure the mounting device to the electrical fixture. The connector may also include at least one redundance member that retains the connector in connection with the electrical fixture during assembly of the electrical fixture and connector. The at least one redundance member may include structure for snap-fitting to surfaces disposed about the opening in the electrical fixture.

In another embodiment, a mounting device for connecting an electrical fixture to a junction box that is mounted to a wall or ceiling surface includes a canopy element that covers the junction box upon connection of the mounting device to the junction box, and a universal mounting plate integrally formed with the connector that connects to the junction box. The canopy element is disposed between the connector and the electrical fixture, and the connector includes flexible tabs that bias against opposing surfaces of the electrical fixture upon attachment of the electrical fixture to the connector to position the canopy element flush against the wall or ceiling surface. The connector may also include at least one hook receivable within an opening in the electrical fixture. The mounting device may also include a locking pin with a camming surface that engages with a surface of the at least one hook of the connector to secure the mounting device to the electrical fixture.

In another embodiment, a mounting device for connecting an electrical fixture to a junction box that is mounted to a wall or ceiling surface includes a canopy element that covers the junction box upon connection of the mounting device to the junction box, a universal mounting plate that connects to the junction box and is disposed between the canopy element and the junction box, and connecting structure integrally formed with the electrical fixture that connects the electrical fixture to the universal mounting plate.

Additional embodiments may include lighting fixtures comprising a housing that includes indicia and at least one illumination source that illuminates the indicia and a mounting device that connects the housing to the junction box. Other embodiments of the present invention may include methods for mounting an electrical fixture to a junction box without the use of special tools.

DETAILED DESCRIPTION OF THE INVENTION

The present invention provides canopy mounting devices that cover junction boxes of various configurations and provide a pleasing, finished appearance to a resulting installation. Canopy mounting devices of this invention provide reliable mounting of exit signs and the like to junction boxes disposed in or on ceilings or walls and may be installed without requiring special tools. Certain embodiments of a canopy mounting device include a universal mounting plate integrally formed with a connector of the mounting device such that direct mounting to junction boxes of different configurations is possible. Screws or other fasteners that connect the junction box to the sign housing through the universal mounting plate element are covered by outer portions of a canopy element of the mounting device in a finished installation such that the screws and fasteners are not visible. Additionally, certain embodiments may include structure capable of accommodating not only appropriate mountings of junction boxes within ceilings or walls but also inappropriate mountings, such as when junction boxes are recessed too deeply within a ceiling or wall or mounted with junction box edges extending outwardly from the ceiling or wall.

Illuminated signs and the like, such as exit signs and combination emergency lighting/exit sign fixtures, take a variety of forms and may be configured for use with canopy mounting devices of the present invention. One example of such a sign housing with which canopy mounting devices of this invention may be used is a housing frame disclosed in U.S. Pat. No. 5,988,825 to Masters et al., entitled "Housing Frame for Illuminated Signs Having Multiple Configurations," which is incorporated herein by reference in its entirety. Another example is of a fixture that may be used with canopy mounting devices of this invention is a combination emergency lighting unit/exit sign fixture disclosed in U.S. Pat. No. 5,797,673 to Logan et al., entitled "Emergency Lighting Unit/Exit Sign Combination," which is incorporated herein by reference in its entirety. Other illuminated sign housings available in the marketplace may also be used with canopy mounting devices of this invention, provided such sign housings have openings in the housing frame that can receive canopy mounting devices according to this invention.

Figure 1:
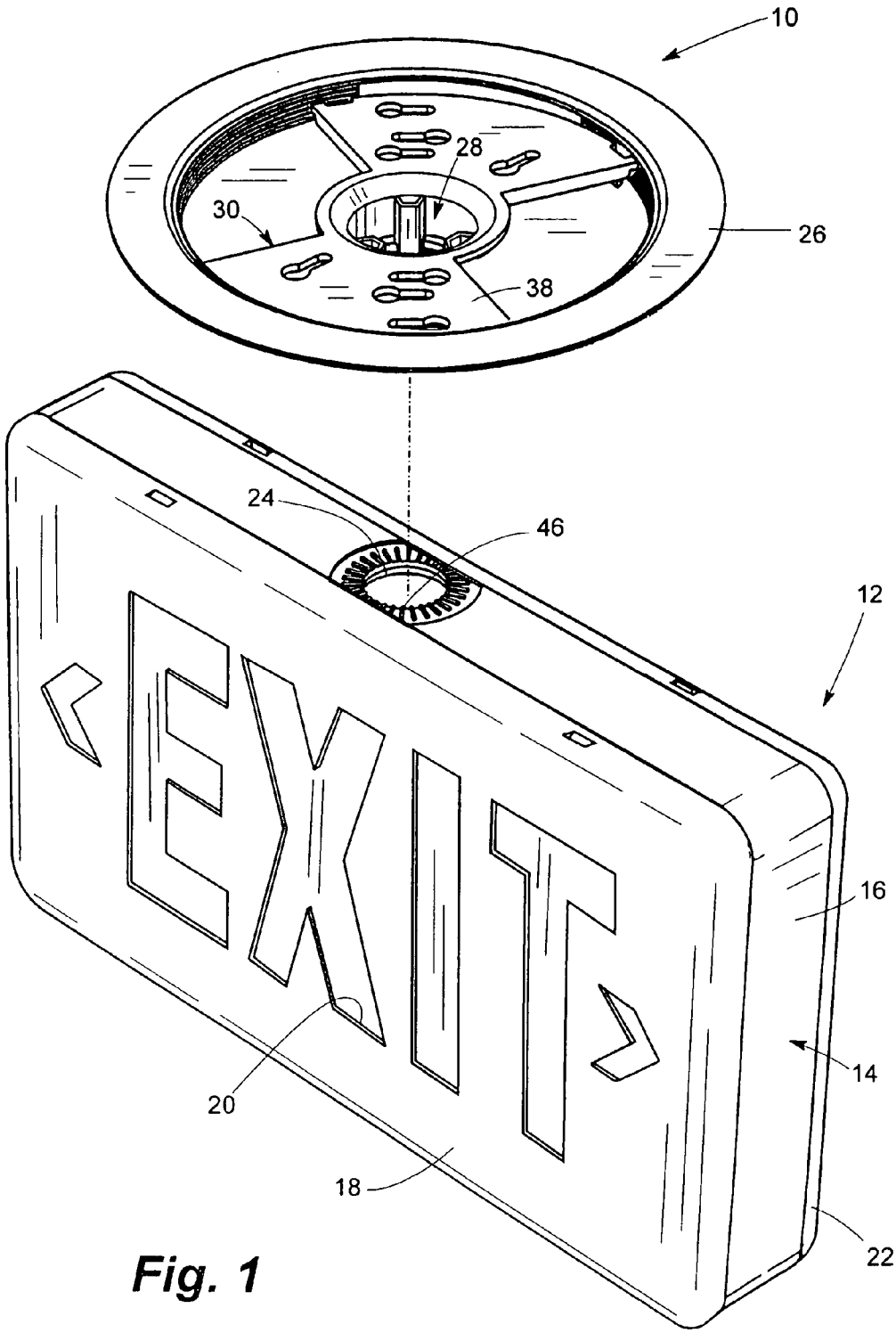
FIG. 1 is an exploded perspective view of an embodiment of a canopy mounting device according to the present invention, shown in relation to an exit sign housing.
Figure 2:
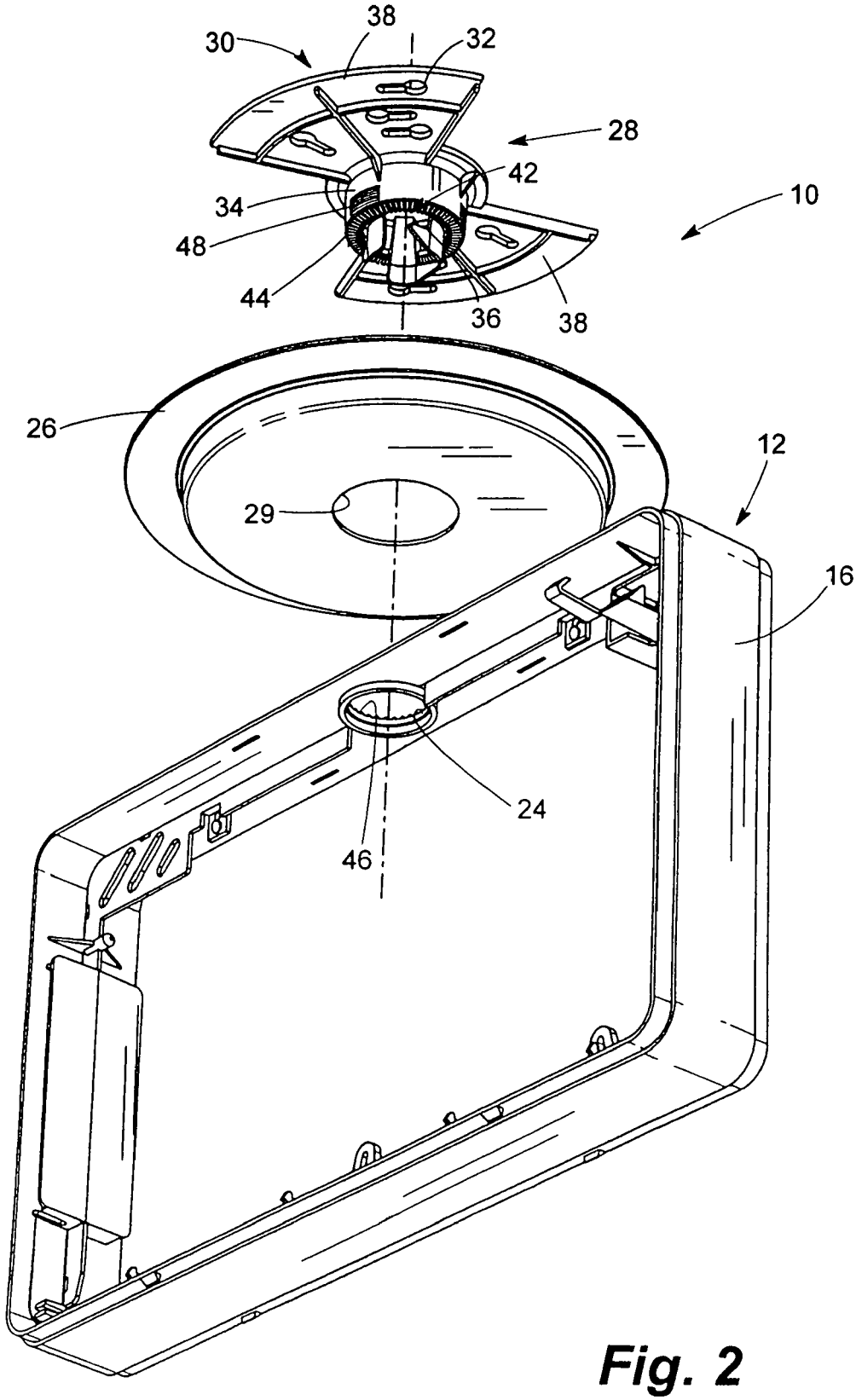
FIG. 2 is an exploded view of the assembly of FIG. 1.
Figure 3:
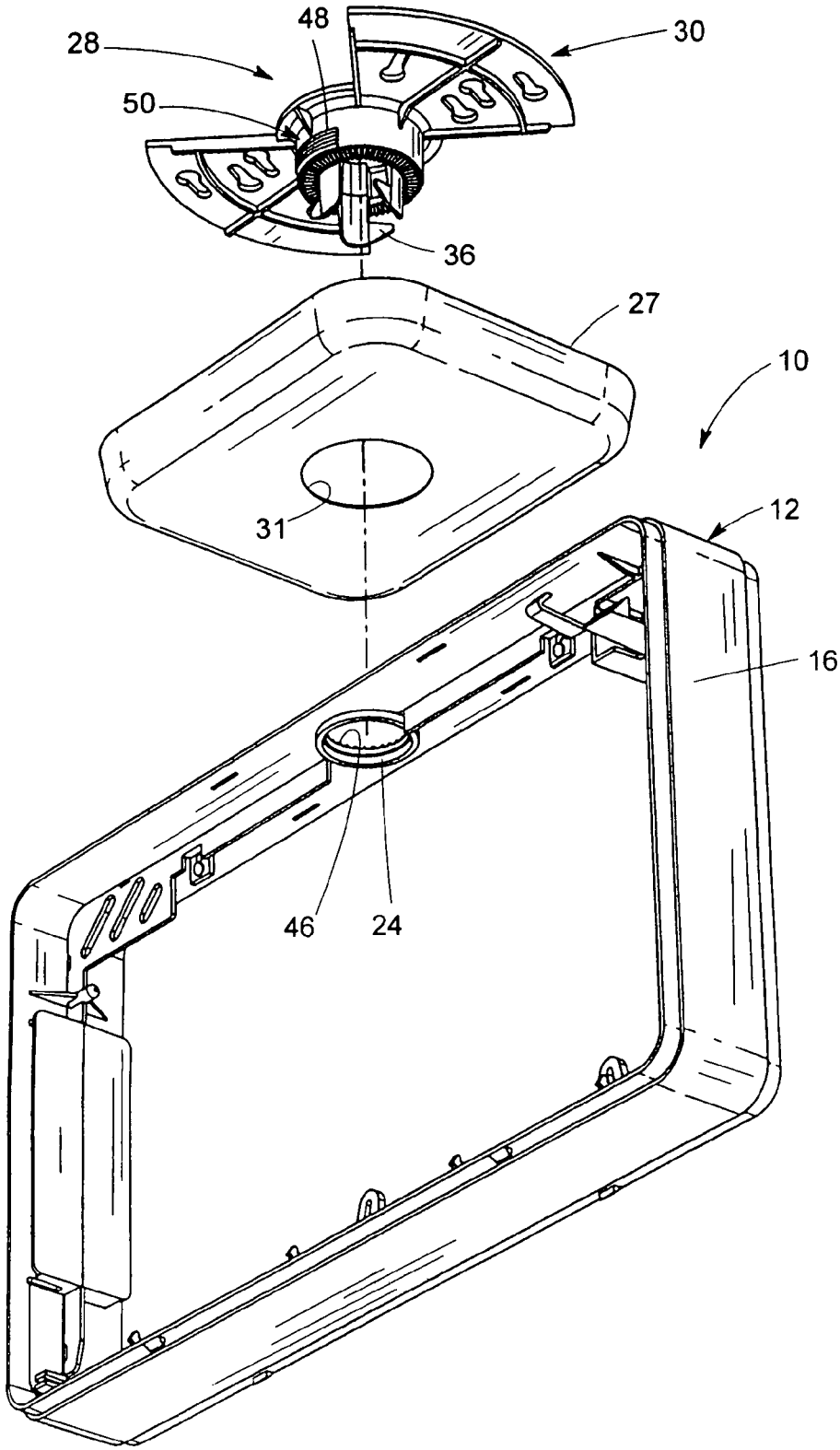
FIG. 3 is an exploded view of an assembly similar to the assembly of FIG. 2, but with a differently shaped canopy element.
Figure 7:
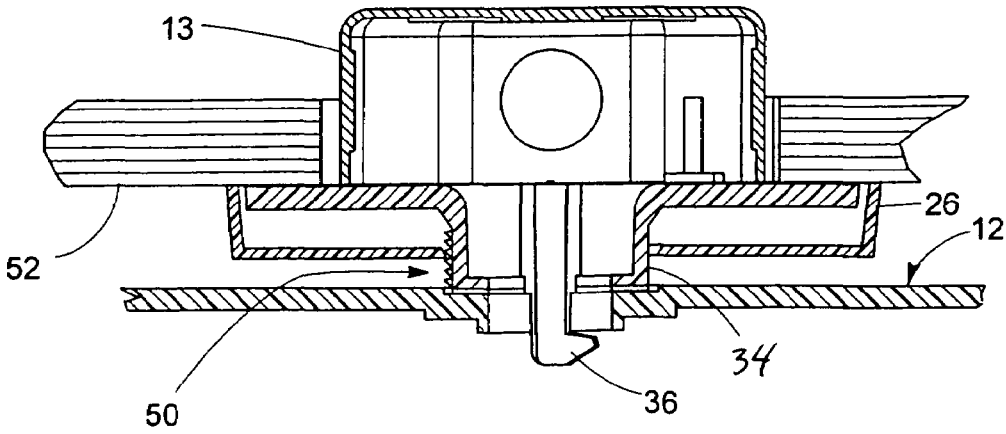
FIG. 7 is a sectional side elevation view of a portion of a sign mounted to a ceiling by the mounting device of FIGS. 1 and 2, where a junction box has lower edges flush mounted with the ceiling.
Figure 8:
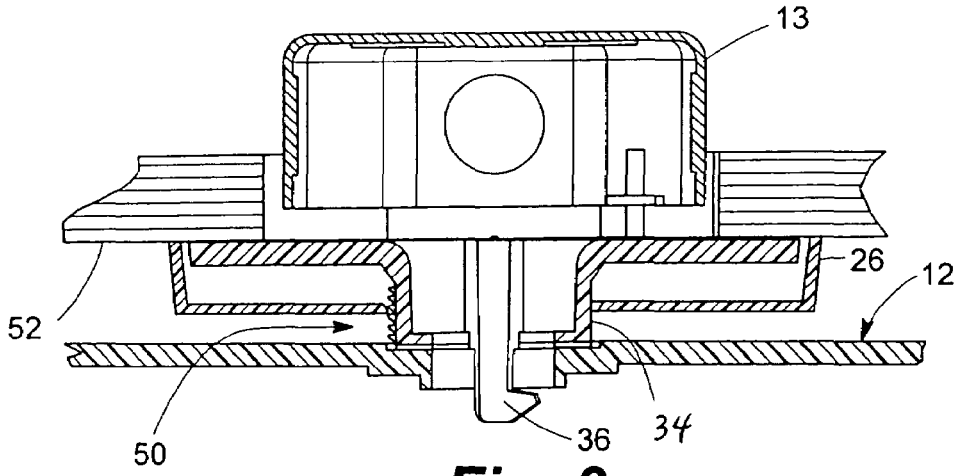
FIG. 8 is a sectional side elevation view of a portion of a sign mounted to a ceiling by the mounting device of FIGS. 1 and 2, where a junction box has lower edges recessed within the ceiling.
Figure 9:
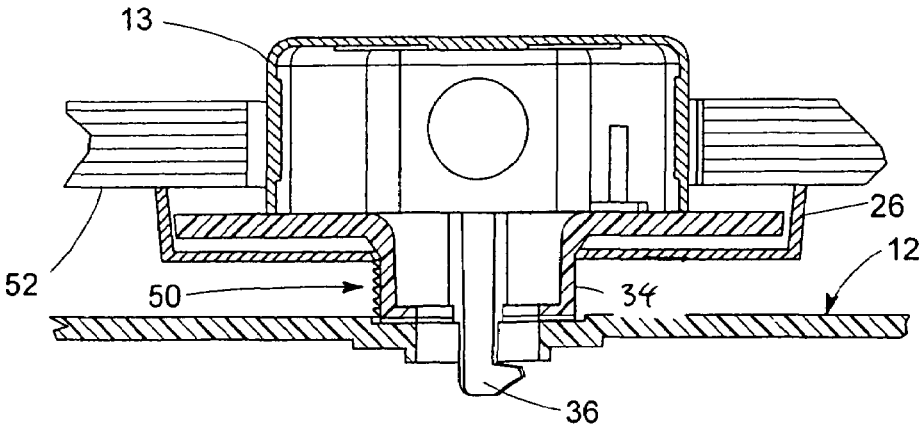
FIG. 9 is a sectional side elevation view of a portion of a sign mounted to a ceiling by the mounting device of FIGS. 1 and 2, where a junction box has lower edges protruding from the ceiling.
Figure 10:
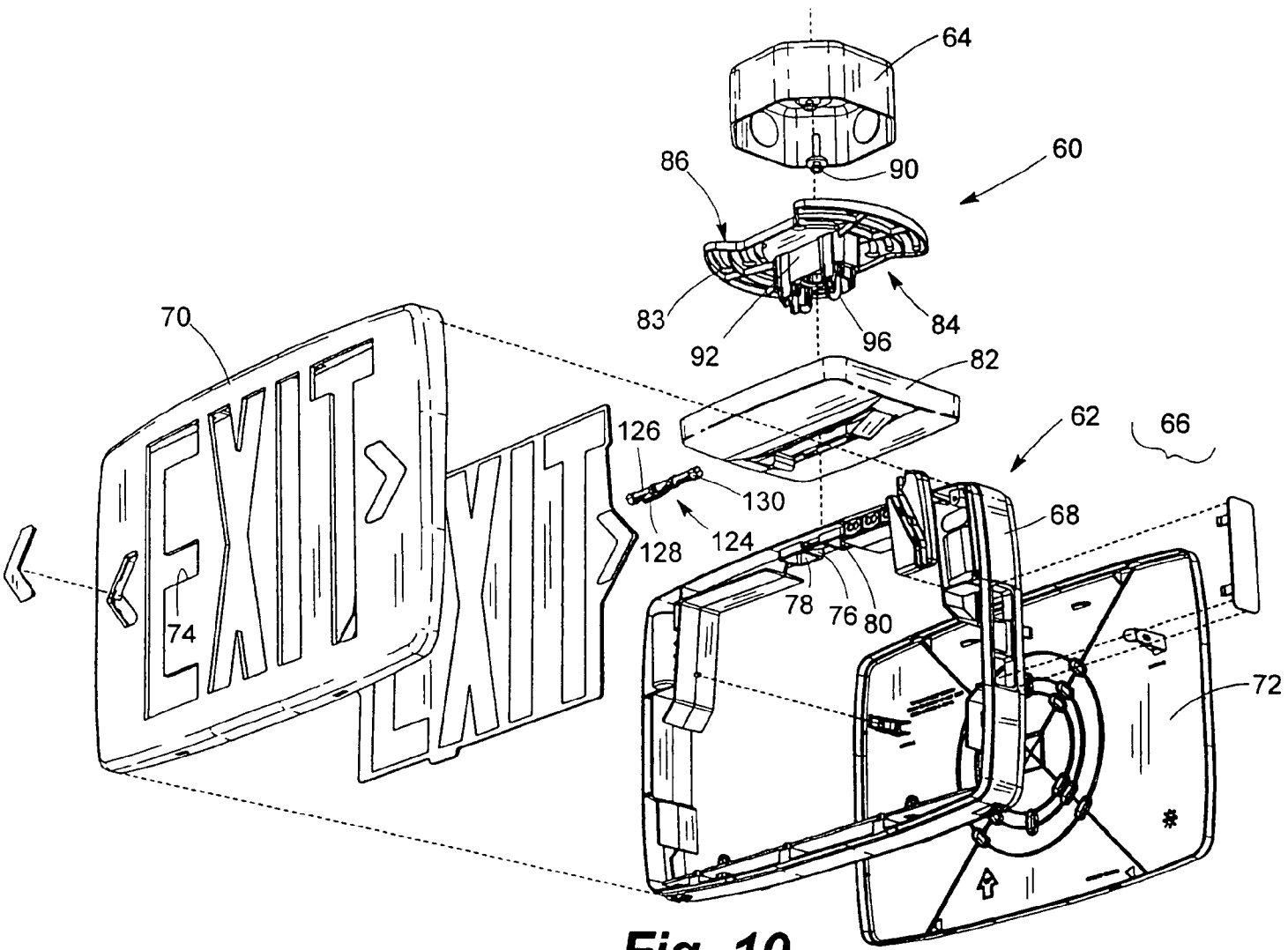
FIG. 10 is a exploded perspective view of another embodiment of a canopy mounting device according to the present invention, shown in relationship to an exit sign and a junction box.

Referring now to the drawings and particularly to FIGS. 1-3, one embodiment of a canopy mounting device according to this invention is shown. A mounting device 10 connects to and mounts an exit sign 12 to a junction box that is mounted in or on a ceiling, wall, or the like. A junction box 13 is not shown in FIGS. 1-3, but is shown in FIGS. 7-9 which will be described further below. Exit sign 12 includes a housing 14 with a frame 16 and panels 18 and 22. Panel 18 has indicia 20 formed therein in a conventional manner. It should be understood that exit sign 12 may include additional or alternative indicia and that the structure of exit sign 12 may be any structure suitable for mounting to a ceiling, wall, or the like by using mounting device 10. Typically, housing 14 of exit sign 12 includes illumination sources, electrical circuitry, batteries, and other structural elements well understood by those skilled in the art, such elements not being shown in the drawings for ease of illustration.

Frame 16 includes an opening 24 formed in its top portion. Opening 24 may be formed in either end or side of frame 16 to facilitate connection of mounting device 10 in a side-mounted or wall-mounted installation. Mounting device 10 includes a canopy element 26 and a connector 28. Canopy element 26 has a generally circular shape, as shown in FIGS. 1 and 2, but may also have other shapes. For example, canopy element 27, shown in FIG. 3, has a generally rectangular shape. Connector 28 is integrally formed with a universal mounting plate 30 that preferably is shaped similar to a bowtie for conservation of material. Described another way, plate 30 has lateral wings 38 extending from a generally cylindrical body 34 with a central lumen 42 formed therein. Lumen 42 generally aligns with an opening centrally formed in canopy element 26, such as opening 29 in canopy element as shown in FIG. 2 or opening 31 in canopy element 27 as shown in FIG. 3. Lumen 42 and opening 29 (or opening 31) generally have a common longitudinal axis that is also common with a longitudinal axis of opening 24 in housing frame 16. Electrical wiring (not shown) is trainable from junction box 13 (shown in FIGS. 7-9) through aligned openings 24 and 29 and further including lumen 42 in order to provide internal power to exit sign 12.

Canopy element 26 is generally the visible portion of mounting device 10 once mounting device 10 is mounted to both exit sign 12 and junction box 13. Canopy elements 26 and 27 do not have holes formed therein for the receipt of screws or other fasteners as is necessary in mounting existing canopy mounting devices.

Mounting device 10 is connected to junction box 13 by using universal mounting plate 30. Two screws (not shown) extend through apertures 32 formed in universal mounting plate 30 in known patterns and facilitate connection of mounting device 10 to junction boxes of various configurations. Junction boxes of differing structure and having screw-receiving apertures (not shown) typically formed in metal tabs integral with the junction boxes, such that screws from a mounting plate connect with a junction box through apertures such as apertures 32, are well known to those skilled in the art. However, existing mounting devices generally utilize a universal mounting structure that is a separate metal piece connected by two screws to a junction box and then connected by two other screws to a canopy element of the mounting device. Two of these screws are eliminated in the embodiment shown in and described with reference to FIGS. 1-3. Additionally, mounting device 10 provides a more pleasing appearance because no apertures are required in canopy elements 26 and 27, and no screw heads are visible once the canopy element is installed. Furthermore, mounting device 10 is more easily installed because canopy element 26 is not connected by screws to a separate universal mounting plate.

Figure 4:
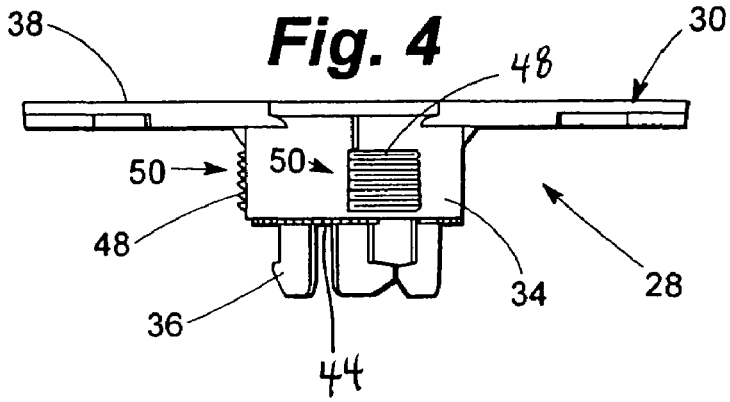
FIG. 4 is a side elevation view of a connector of the canopy mounting device of FIGS. 1 and 2.
Figure 5:
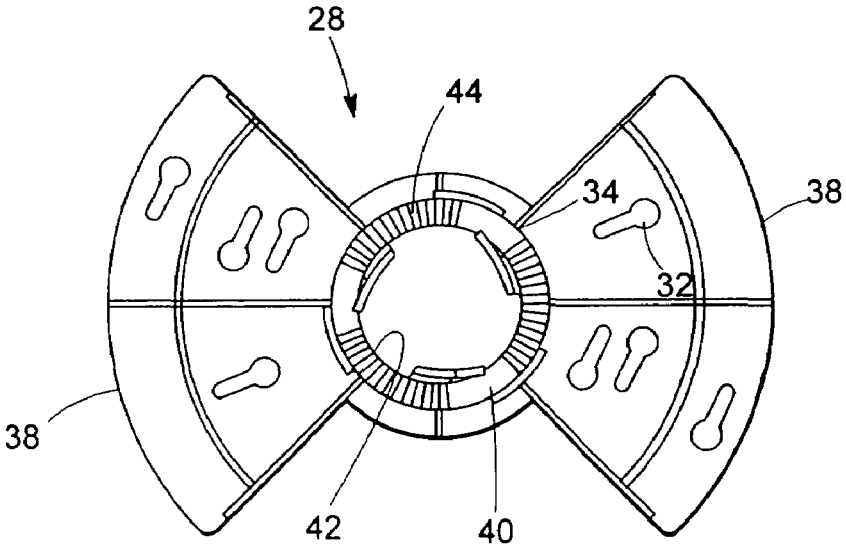
FIG. 5 is a bottom view of the connector of FIG. 4.
Figure 6:
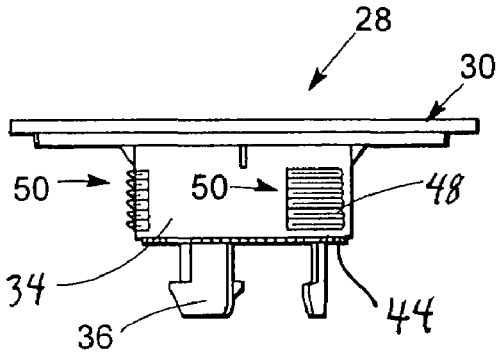
FIG. 6 is a side elevation view of the connector of FIG. 4, rotated relative to the orientation shown in FIG. 4.

Referring now also to FIGS. 4-6, body 34 of connector 28 includes an annular wall 40 that extends into lumen 42. Wall 40 includes a plurality of radial ridges 44 that mate with similarly configured ridges 46 disposed about opening 24 of frame 16 of the exit sign. Radial ridges 44 mate with ridges 46 on frame 16 of the exit sign to prevent rotation of the exit sign relative to mounting device 10. Connector 28 also includes torsion hooks 36 that extend downwardly from body 34, as shown in FIGS. 4 and 6. Torsion hooks 36 are insertible into opening 24 in frame 16 of exit sign housing 14. In the embodiment shown in FIGS. 4-6, three torsion hooks 36 are spaced about body 34. Torsion hooks 36 can take the form of similar elements disclosed in U.S. Pat. No. 5,797,673, which was previously incorporated herein by reference.

As best seen in FIGS. 4-6, body 34 of connector 28 has a plurality of circumferential ridges 48 that extend vertically from near the bottom of body 34 toward the top of body 34. There are three spaced groupings 50 of ridges 48. Ridges 48 assist in locating mounting device 10 up against a ceiling or wall to which device 10 is intended to mount an exit sign, such as exit sign 12. It should be understood that ridges 48 could be formed about the full circumference of body 34, if desired.

Ridges 48 function sequentially as connector 28 is pushed through opening 24 of frame 16 to locate mounting device 10 and particularly canopy element 26 up against a ceiling, such as ceiling 52 as shown in FIGS. 7-9. In FIG. 7, a detail side sectional view is shown of junction box 13 flush fitted within ceiling 52, as desired when a junction box is in a properly recessed position within a ceiling. Ridges 48 facilitate a flush mounting of canopy element 26 to ceiling 52 by positioning canopy element 26 relative to a particular one of the plurality of ridges 48 in each grouping 50.

As shown in FIG. 8, junction box 13 is improperly mounted in ceiling 52 such that the outer edges of junction box 13 are not flush with ceiling 52. That is, the outer edges of junction box 13 are recessed from the outer surfaces of ceiling 52. Ridges 48 function to snug mounting device 10 up against ceiling 52 such that the inappropriate distance between mounting device 10 and junction box 13 is accommodated. Similarly, FIG. 9 shows junction box 13 improperly mounted such that edges of junction box 13 extend outwardly of ceiling 52. Ridges 48 permit accommodation of the inappropriate installation of junction box 13 within ceiling 52 such that canopy element 26 may be located flush relative to ceiling 52 by pushing canopy element 26 upward to engage ridges 48 toward the top of each grouping 50 of ridges 48. Ridges 48 function most effectively when peripheral edges about opening 29 in canopy element 26 are configured to flex slightly to allow ratcheting action. Alternatively, slot-like notches (not shown) may be formed in body 34 laterally of each of groupings 50 to permit flexing of body 34.

Another embodiment of a canopy mounting device according to the present invention is shown in FIGS. 10-21. A mounting device 60 mounts a sign, such as an exit sign 62, to a junction box 64. Junction box 64 is mounted in a ceiling 140 (not shown in FIGS. 10-18, but shown in FIGS. 19-21) or in a wall (not shown) in a conventional manner well known to those skilled in the art. Exit sign 62 includes a housing 66 with a frame 68 and panels 70 and 72. At least one of panels 70 and 72 has indicia 74 formed therein, such as "EXIT", in a conventional manner well known to those skilled in the art. An upper portion of frame 68, as well as one or more side portions of frame 68, can each be provided with a central opening 76 flanked by two side openings 78 and 80. Openings 76, 78, and 80 are well known to those skilled in the art and examples of such openings are further described in U.S. Pat. No. 5,526,251 to Andre et al., entitled "Emergency Lighting Connections," which is incorporated herein by reference in its entirety. Openings 76, 78 and 80 receive portions of mounting device 60, as further described below, for mounting exit sign 62 to junction box 64.

Mounting device 60 includes a canopy element 82 and a connector 84 that has an integrally-formed universal mounting plate 86. Mounting plate 86 has a plurality of apertures 83 through which screws 90 or similar fasteners may be inserted to connect mounting plate 86 directly to junction box 64. Apertures 83 are shown most clearly in FIG. 18D. Connector 84 has a central body 92 that is open at the juncture of mounting plate 86 and body 92, an opposite face of body 92 having an opening 94 formed therein. Hooks 96 are disposed one at each end of body 92 and extend from the surface within which opening 94 is formed. A pair of guide elements 98 are spaced one each on either side of body 92, as shown in FIGS. 12 and 13.

Figure 18A:
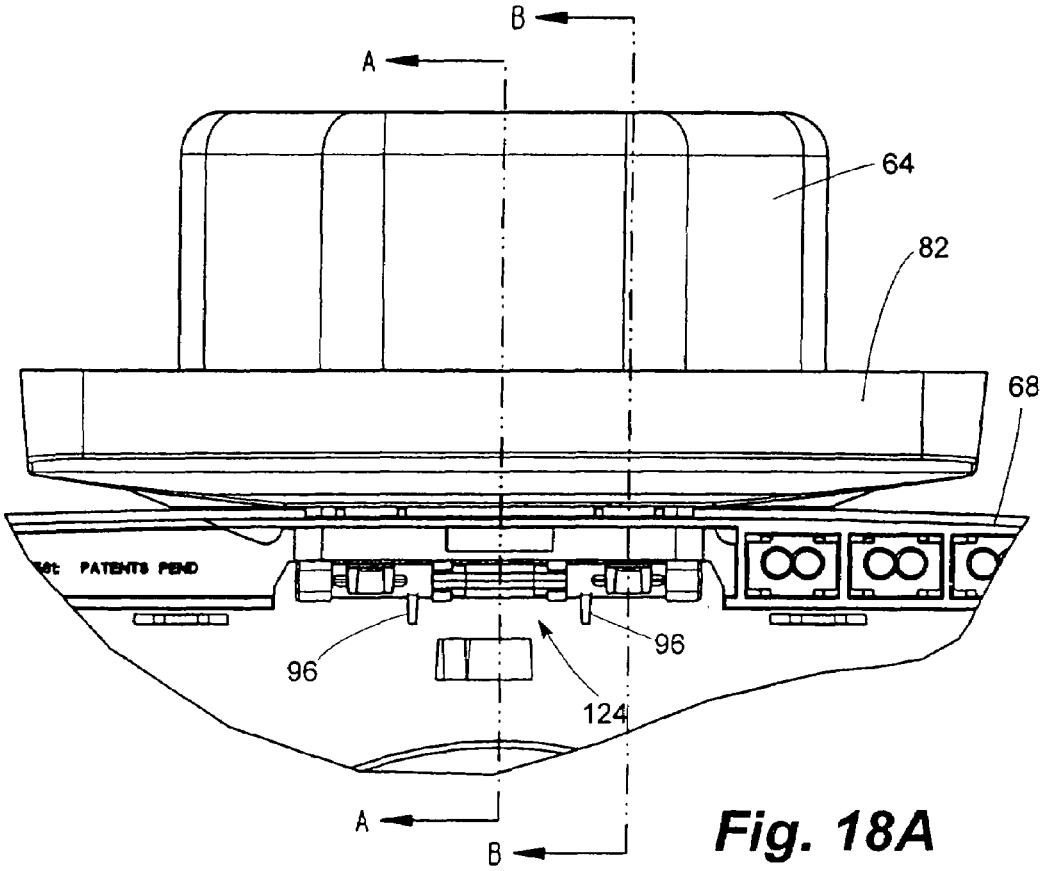
FIG. 18A is a detail view of a portion of the mounting device of FIGS. 10-16, shown assembled and mounted to a junction box and a portion of an exit sign housing.
Figure 18B:
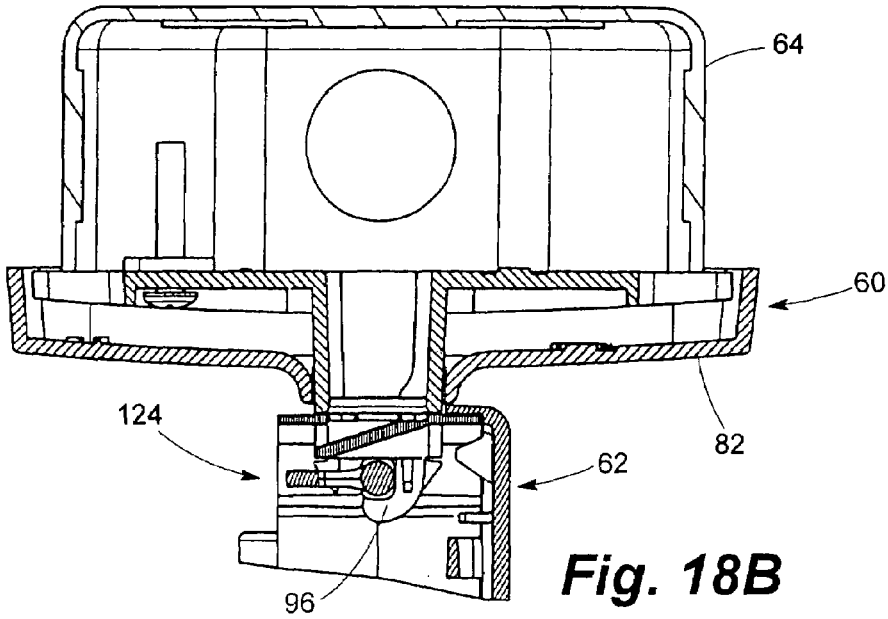
FIG. 18B is a section view of the assembly of FIG. 18A along lines A-A of FIG. 18A.
Figure 18C:
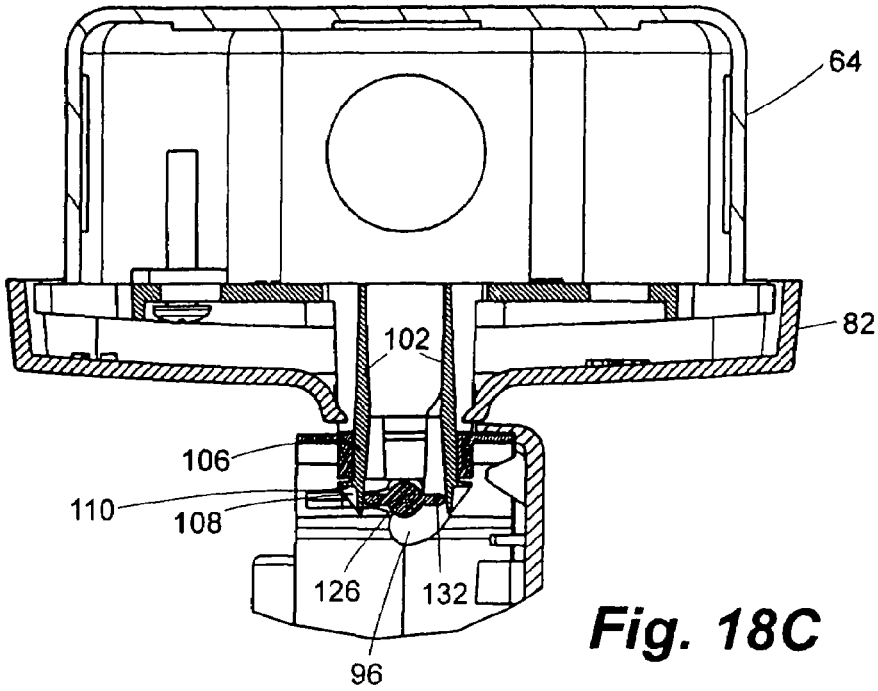
FIG. 18C is a section view of the assembly of FIG. 18A along lines B-B of FIG. 18A.
Figure 18D:
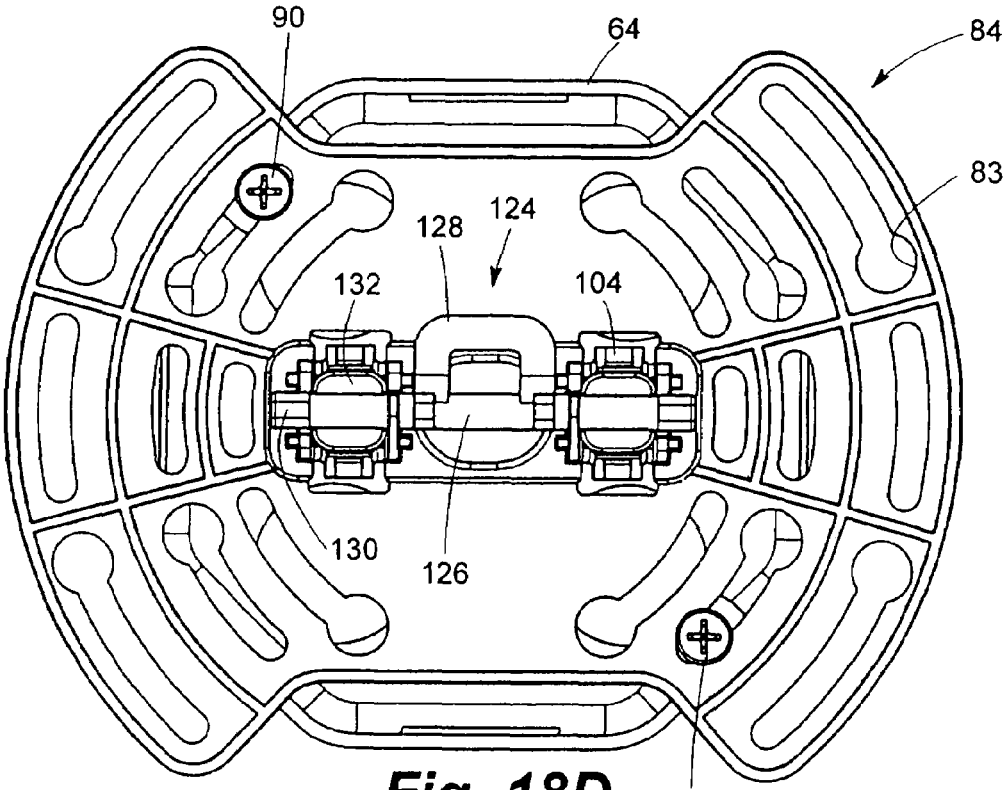
FIG. 18D is a bottom view of the mounting device of FIG. 18A shown with a covering canopy element removed in order to view attachment of a remaining portion of the mounting device to a junction box.

A pair of redundance fittings 100 are spaced outwardly of body 92 and adjacent thereto. Each of redundance fittings 100 has a base 102 (shown in FIG. 18C) extending from the plane of plate 86 and openings (formed as a mold release expedient and not shown) formed in plate 86 outwardly of an inner end of each base 102. Referring to FIG. 18C, a flex arm 106 extends from each base 102 and terminates in a barb member 108. Each barb member 108 has a detent surface 110 that fits against an opposite side of an edge 79 of one of side openings 78 and 80, as best seen in FIG. 12.

Insertion of redundance fittings 100 into side openings 78 and 80 results in an inward flexing of arms 106 and barb members 108. Insertion of fittings 100 a sufficient distance causes barb members 108 to pass beyond edges 79 such that barb members 108 spring outwardly due to a release of compression on flex arms 106, thereby causing each of detent surfaces 110 to fit over edges 79. Fittings 100 maintain mounting device 60 in place prior to installation of structure, which is further described below, that functions to positively lock mounting device 60 to exit sign 62. Additionally, fittings 100 provide a back-up fastening function.

Figure 12:
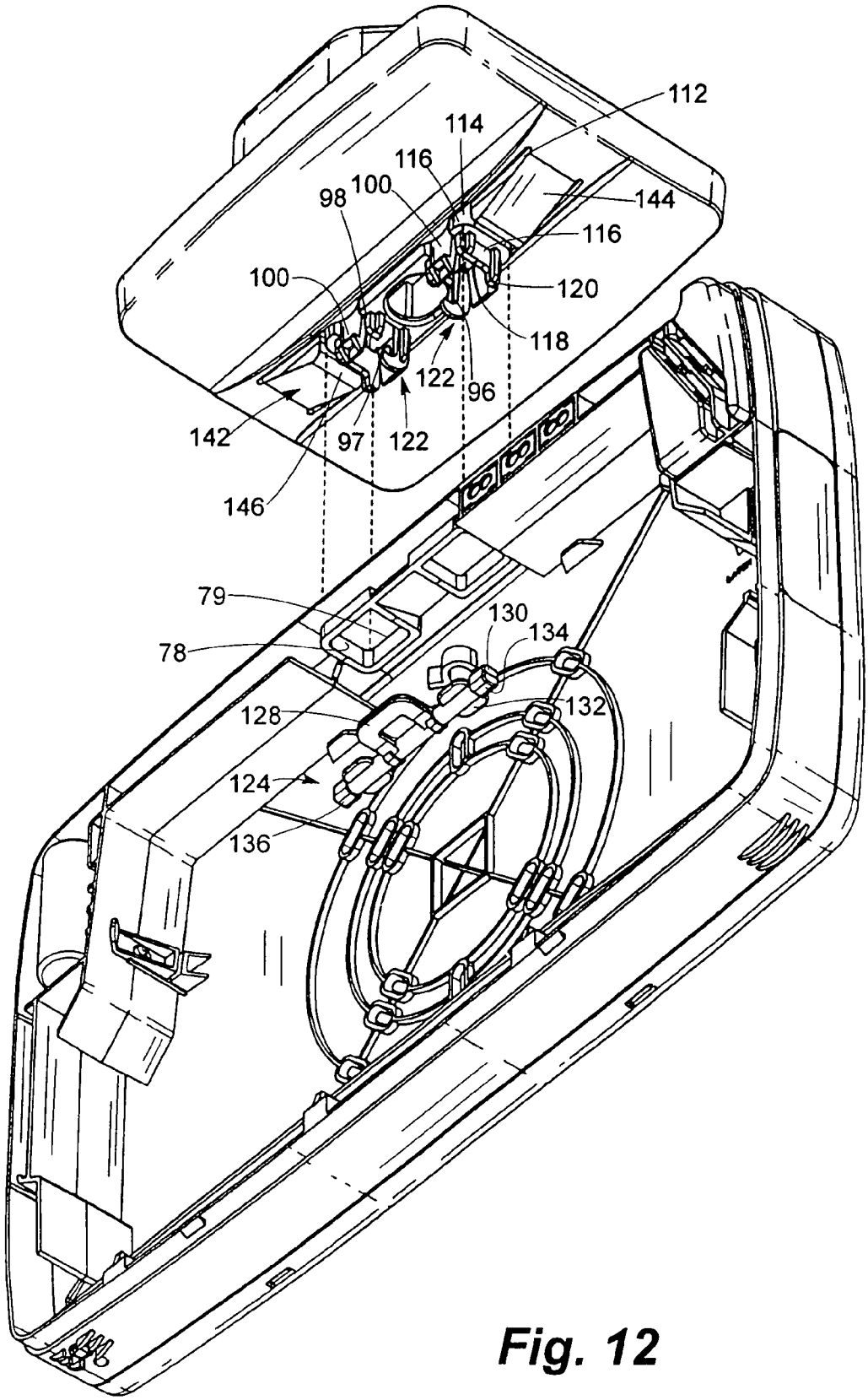
FIG. 12 is an exploded view of the mounting device of FIGS. 10 and 11 mounted to a junction box and spaced from an exit sign housing that is to be mounted by the mounting device.
Figure 13:
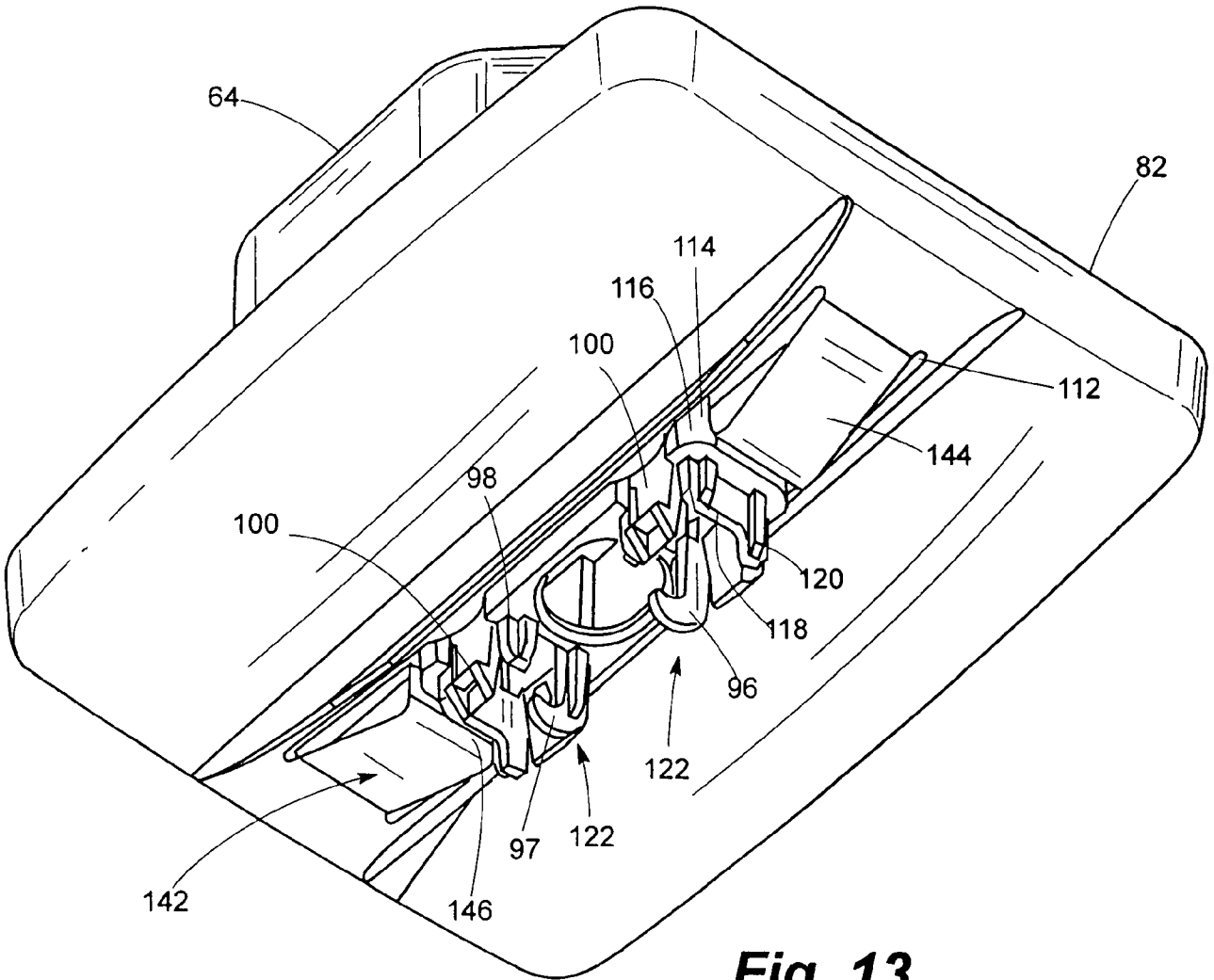
FIG. 13 is a perspective view of the mounting device of FIGS. 10-12 mounted to a junction box.
Figure 14:
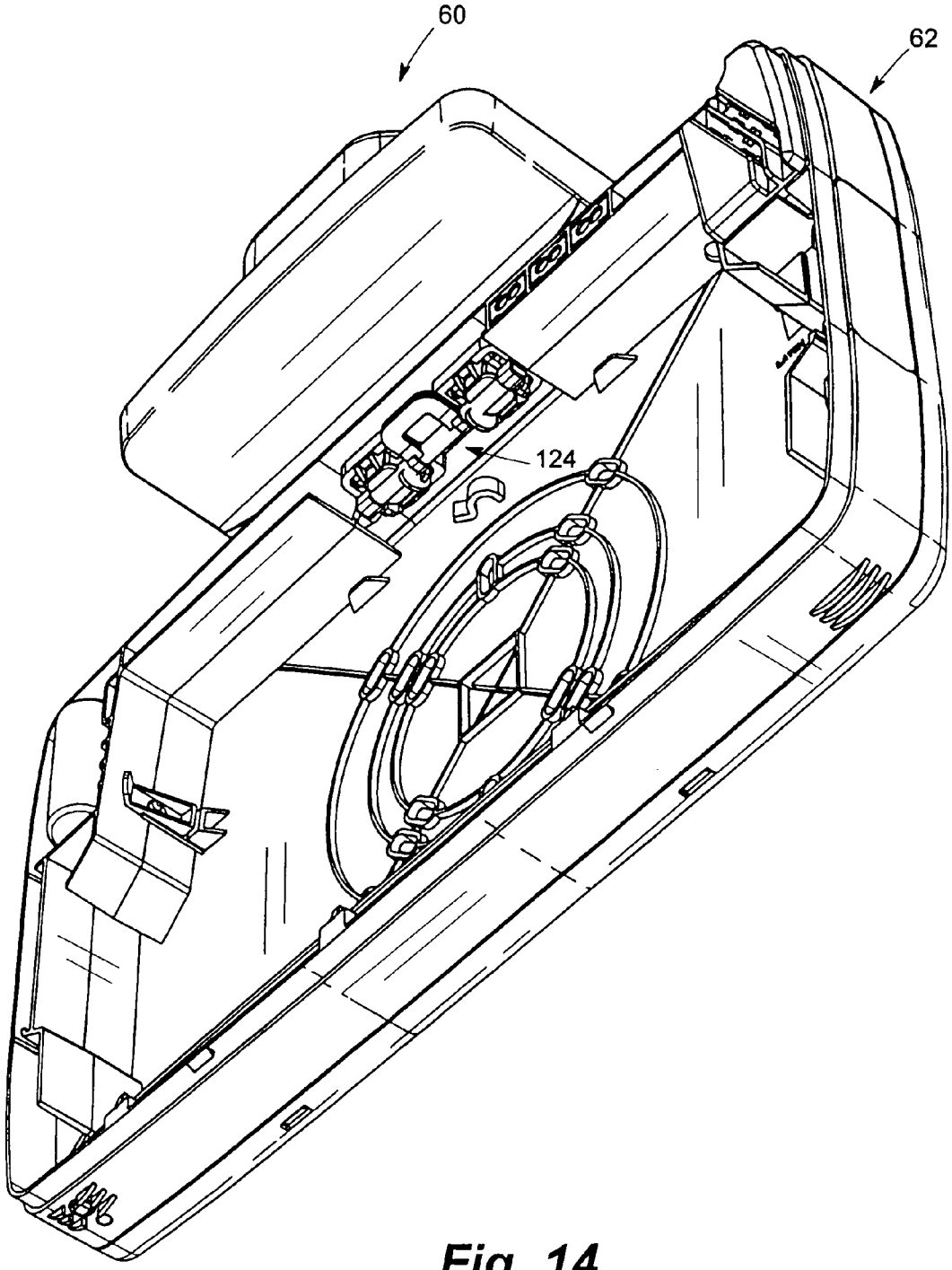
FIG. 14 is a perspective view of the mounting device of FIGS. 10-13 mounted to an exit sign, with a front panel of the exit sign removed.
Figure 15:
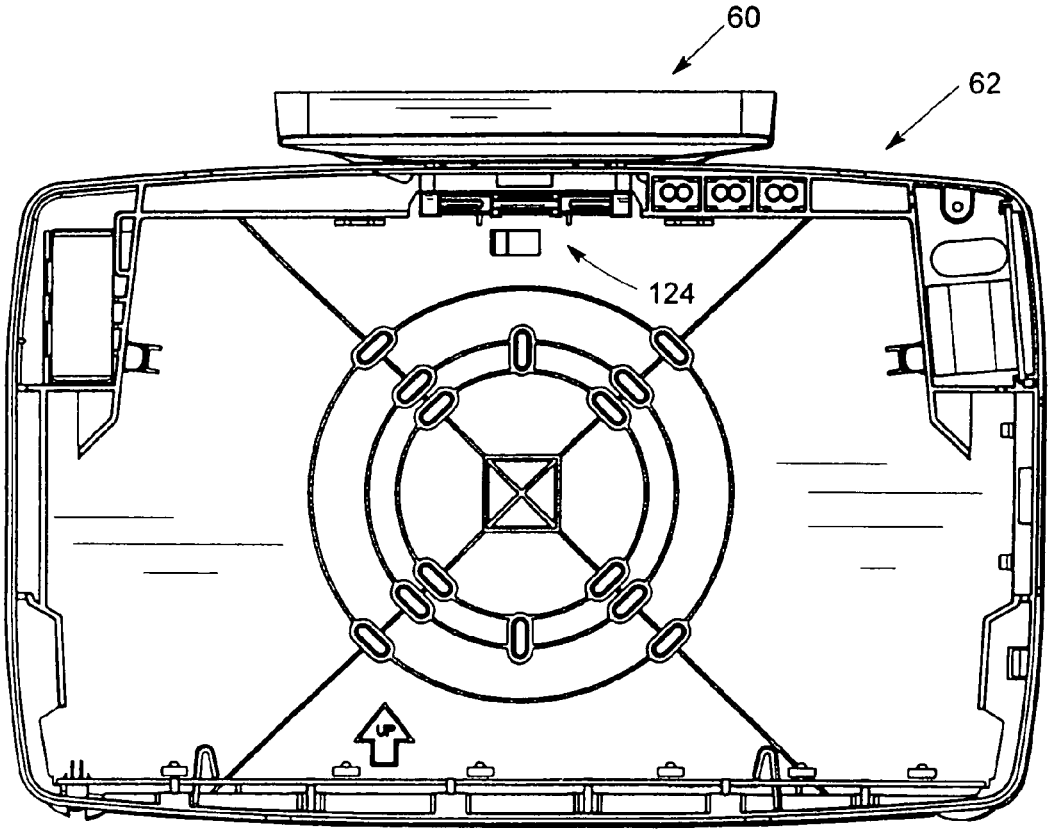
FIG. 15 is a front elevation view of the mounting device and exit sign assembly of FIG. 14.

As shown in FIGS. 12 and 13, lateral guide elements 112 with rounded corners 114 are disposed outwardly of fittings 100. Guide elements 112 generally extend to the same height above the plane of mounting plate 86 as body 92. Guide elements 112 respectively fit into side openings 78 and 80 and are contiguous with outer surfaces of openings 78 and 80. Cam plates 116 extend one each from inner sides of guide elements 112 and provide cam surfaces 118 along free edges thereof. Retaining nibs 120 extend upwardly from one corner of each of cam plates 116 on that side thereof aligned with hooks 96.

Assembly of mounting device 60 to exit sign 62 begins by inserting respective assemblies 122 into side openings 78 and 80 in frame 68 of exit sign 62. Each assembly 122 includes a body 92, a hook 96, a guide element 98, two fittings 100, and a cam plate 116. Guide elements 98 and guide elements 112 guide connector 84 into openings 78 and 80 and to fit therewithin.

A cam locking pin 124 is shown in FIGS. 17A-17D. Cam locking pin 124 has an elongated body 126 with a central actuator tab 128 extending therefrom. At each end of body 126 are enlarged knobs 130. Inwardly of knobs 130 are pairs of retaining tabs 132. Knobs 130 are formed with camming surfaces 134 and flats 136 disposed generally perpendicular to camming surfaces 134. Flats 136 are aligned with or on the same side of cam locking pin 124 as retaining tabs 132 and actuator tab 128. The generally coplanar planes in which retaining tabs 132 and actuator tab 128 are disposed are substantially perpendicular to the plane of flats 136.

Figure 16:
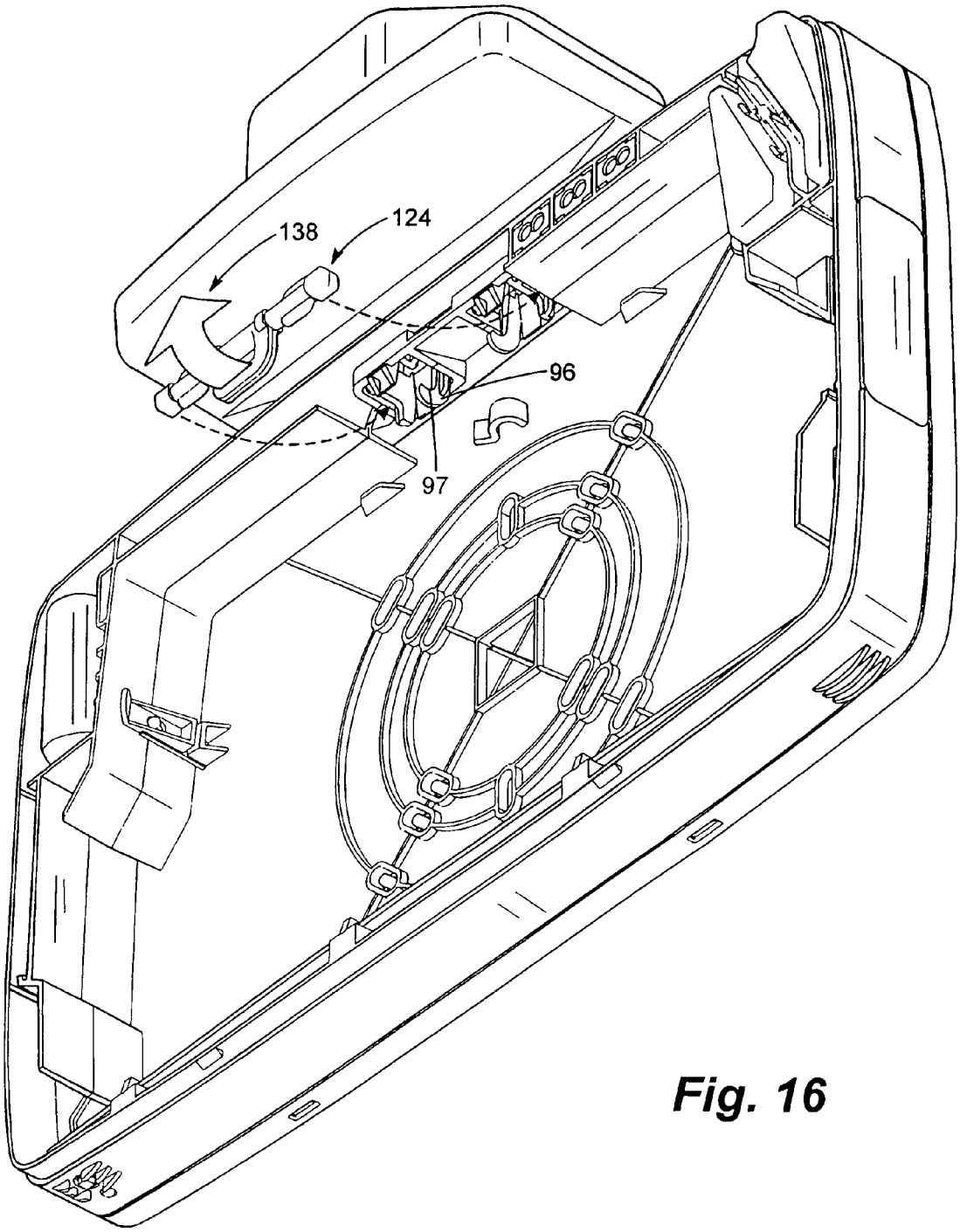
FIG. 16 is a perspective view of the mounting device and exit sign assembly of FIGS. 14 and 15 illustrating locking of the mounting device to the exit sign housing.
Figure 17A:
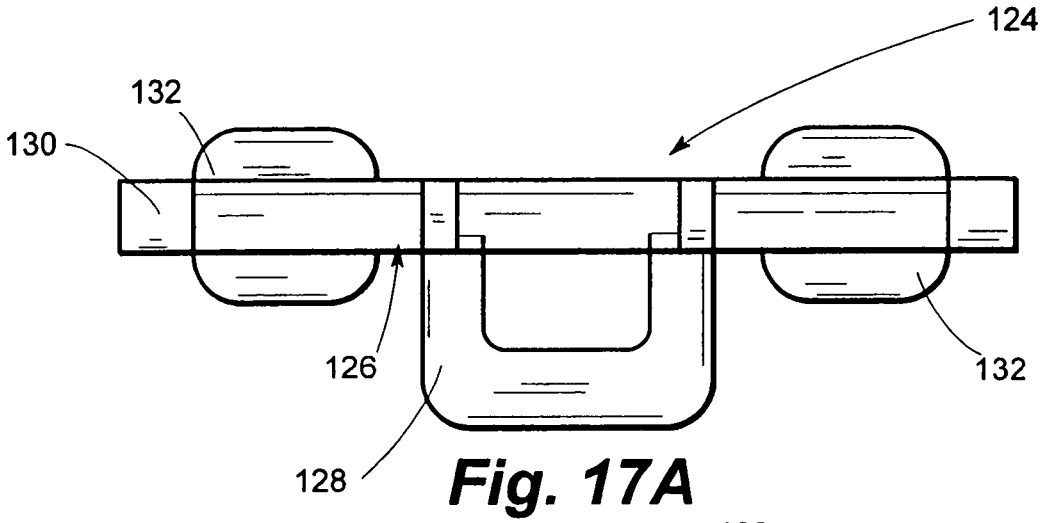
FIG. 17A is a front elevation view of a camming fastener according to an embodiment of the present invention.
Figure 17B:
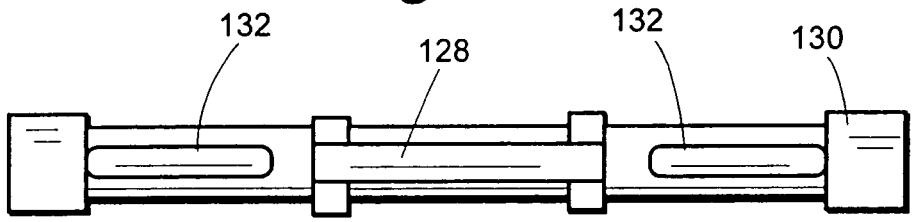
FIG. 17B is a plan view of the fastener of FIG. 17A.
Figure 17C:
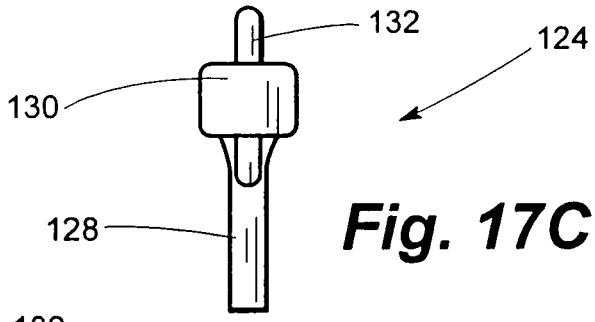
FIG. 17C is a side elevation view of the fastener of FIG. 17A.
Figure 17D:
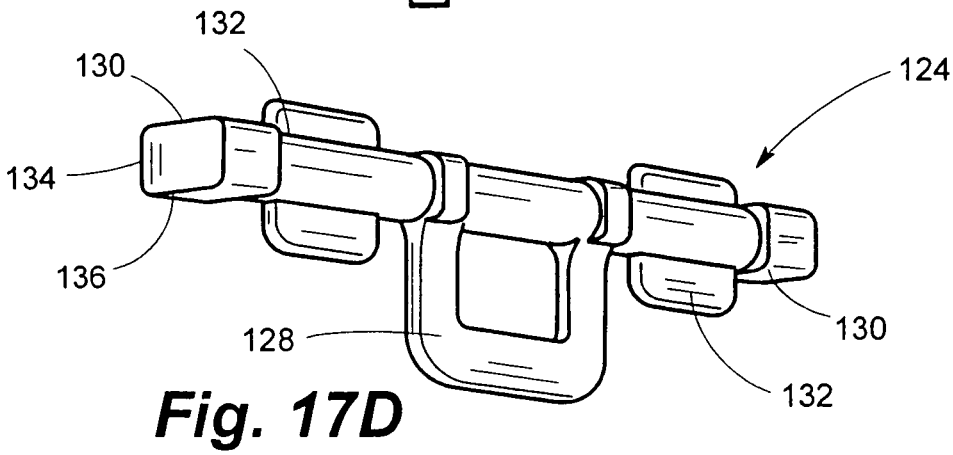
FIG. 17D is a perspective view of the fastener of FIG. 17A.

Referring now to FIG. 16, cam locking pin 124 is inserted into connector 84 after assemblies 122 of connector 84 are inserted into side openings 78 and 80. Actuator tab 128 faces down, or away from connector 84, as cam locking pin 124 is inserted. Insertion of cam locking pin 124 into connector 84 causes portions of cam locking pin 124 to contact inward sloping surfaces 97 of hooks 96, while flats 136 on knobs 130 are adjacent to respective cam surfaces 118 of cam plates 116. In the orientation of cam locking pin 124 shown in FIG. 16, cam locking pin 124 is easily receivable into the above described position. Once in such position, cam locking pin 124 is rotated by 90° using actuator tab 128. Actuator tab 128 is manually rotated in the direction shown by arrow 138 to cause camming surfaces 134 to bias against respective cam surfaces 118 of cam plates 116, thereby locking mounting device 60 to exit sign 62.

Referring to FIG. 18C, it may be appreciated that this 90° rotation of cam locking pin 124 causes retaining tabs 132 to engage inner surfaces of flex arms 106 to prevent inward flexing of flex arms 106 and thus inadvertent dislodgement of redundance fittings 100 from their desired location within side openings 78 and 80. Mounting device 60 is thus securely fastened to and locked in engagement with exit sign 62 by cam locking pin 124.

Wiring (not shown) from junction box 64 may extend through opening 94 of body 92, then through a central opening 87 in canopy element 82, and finally through central opening 76 formed in housing 66 of exit sign 62. The wiring functions conventionally within the interior of exit sign 62, as well understood by those skilled in the art. Openings 94, 87, and 76 are generally aligned so that wiring may easily be pulled from junction box 64 into the interior of exit sign 62. The location of actuator tab 128 of cam locking pin 124 in a fully assembled configuration prevents extension of wiring from a junction box through openings in housing 66 that would provide an undesired pathway for such wiring.

The locations of various structural elements of mounting device 60, when assembled with exit sign 62 and junction box 64, are shown in FIGS. 18A-18D. Cam locking pin 124 is positioned within connector 84 such that the locking position of actuator tab 128 is generally perpendicular to panel 70. This prevents any shadowing of indicia 74 through an unwanted extension of actuator tab 128 into a position overlapping with the plane of indicia 74.

Figure 11:
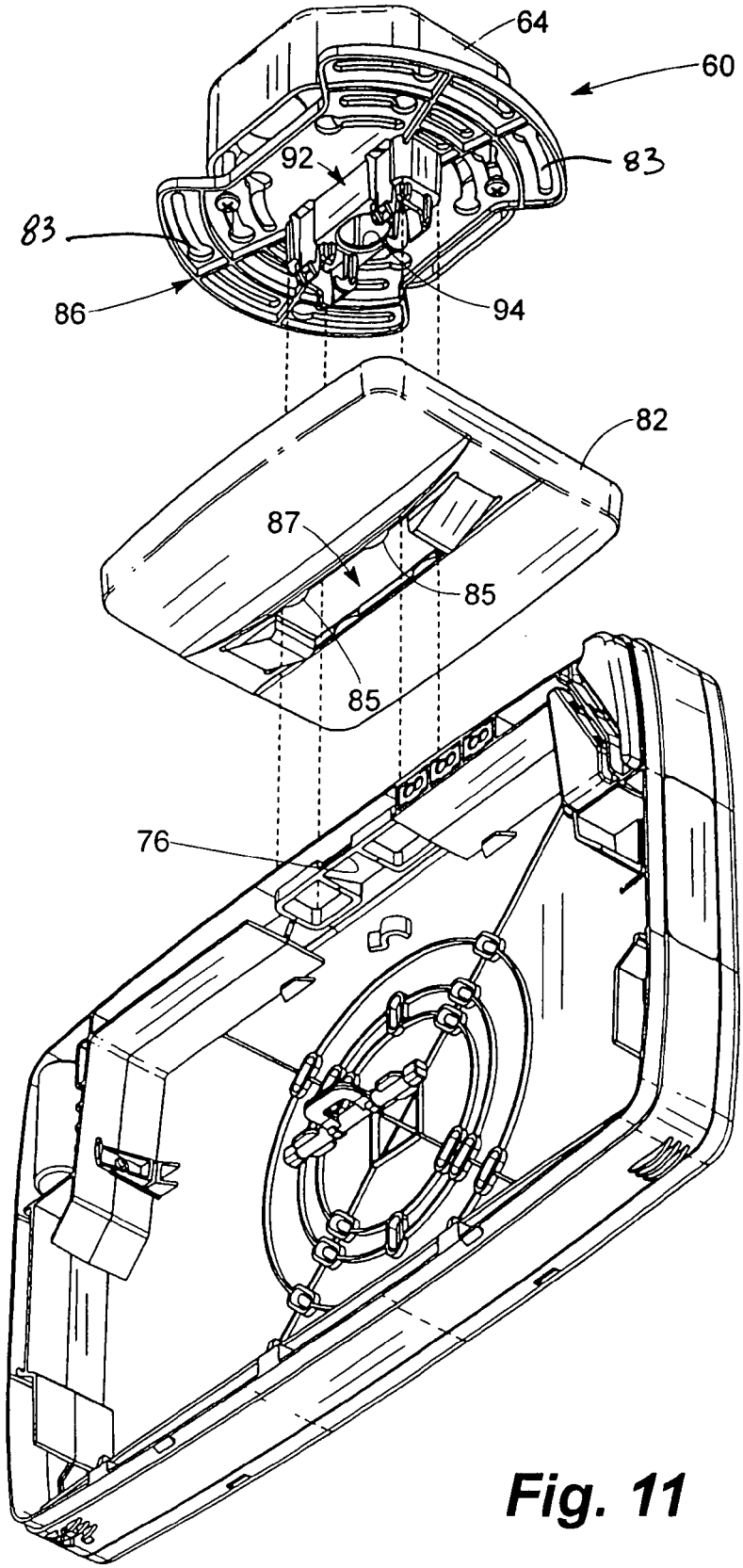
FIG. 11 is a rear perspective exploded view of the mounting device, exit sign, and junction box of FIG. 10 showing a portion of the mounting device mounted to the junction box.

As best seen in FIG. 11, snap tabs 85 extend from each lengthwise side of central opening 87 in canopy element 82. Snap tabs 85 prevent connector 84 from being readily separated from canopy element 82 once connector 84 and canopy element 82 have been connected by pushing portions of connector 84 through opening 87. Barb members 108 of redundance fittings 100 abut snap tabs 85 in this position to prevent accidental or inadvertent dislodgement of connector 84 from canopy element 82. Connector 84 and canopy element 82 may be separated by biasing redundance fittings 100 inwardly to permit passage of fittings 100 through opening 87 of canopy element 82.

Figure 19:
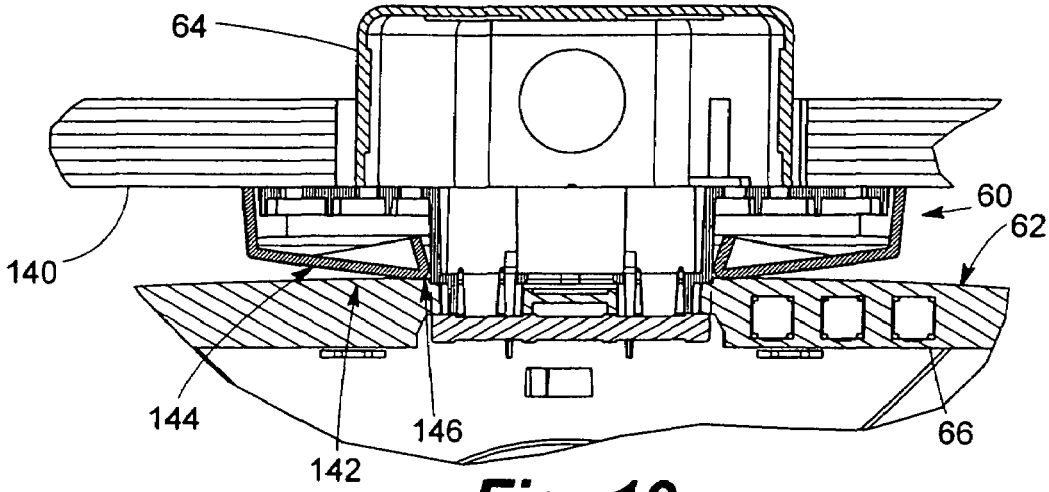
FIG. 19 is a sectional side elevation view of a portion of a sign mounted to a ceiling through the use of the mounting device of FIGS. 10-16 and 18A-18D, where a junction box has lower edges flush mounted with the ceiling.
Figure 20:
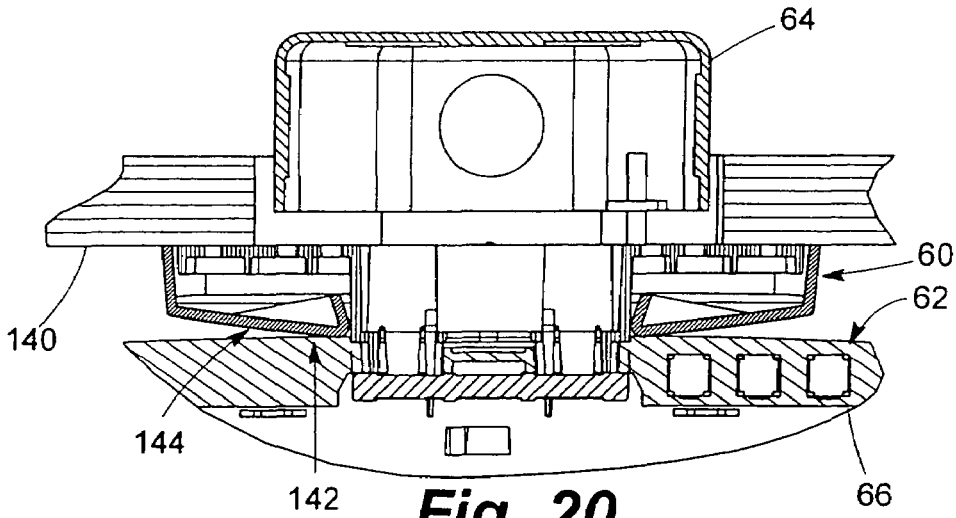
FIG. 20 is a sectional side elevation view of a portion of a sign mounted to a ceiling by the mounting device of FIGS. 10-16 and 18A-18D, where a junction box has lower edges recessed within the ceiling.
Figure 21:
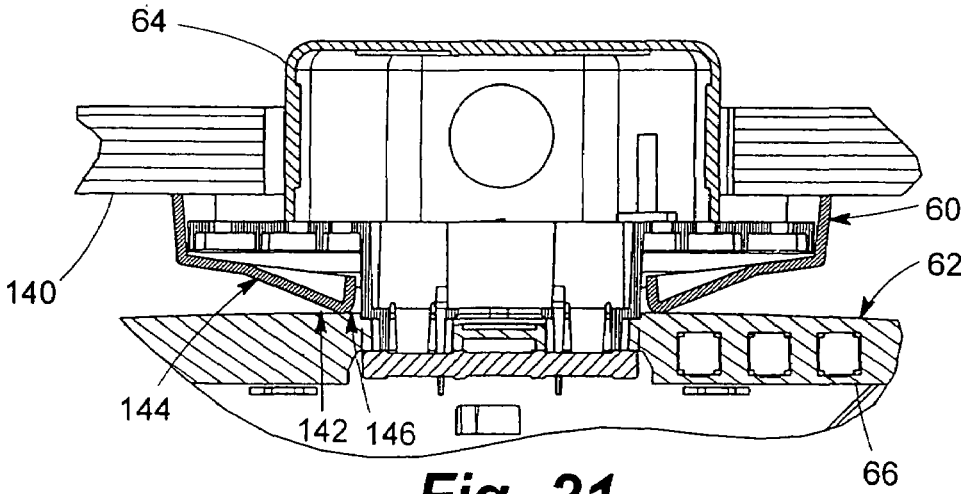
FIG. 21 is a sectional side elevation view of a portion of a sign mounted to a ceiling by the mounting device of FIGS. 10-16 and 18A-18D, where a junction box has lower edges protruding from the ceiling.

Referring now to FIGS. 19-21, canopy element 82 accommodates installation of junction box 64 in a variety of positions in a ceiling 140. FIG. 19 shows a detail side sectional view of junction box 64 flush fitted within ceiling 140, as is desired in a proper installation of a junction box within a ceiling. In FIG. 20, junction box 64 is recessed within ceiling 140 a greater degree than is desired in a proper installation, while FIG. 21 shows junction box 64 with its edges extending outwardly of ceiling 140, which is also not desirable.

However, it is necessary to accommodate the various junction box mounting positions shown in FIGS. 19-21. To do so, resilient tabs 142 are provided at either end of opening 87 of canopy element 82. Each resilient tab 142, also shown in FIG. 12, is provided with a base plane 144 that extends outwardly from canopy element 82. Each base plane 144 terminates in a rounded biasing surface 146. In a situation, such as that shown in FIG. 19, where the junction box 64 is properly mounted within ceiling 140, resilient tabs 142 bias against upper surfaces of exit sign 62 with little flexure of resilient tabs 142 being necessary to "snug" canopy element 82 up against ceiling 140.

In FIG. 20, where junction box 64 is recessed too deeply within ceiling 140, resilient tabs 142 are compressed inwardly to a greater degree than occurs when housing 66 of exit sign 62 is ordinarily pushed onto mounting device 60. This additional compression of tabs 142 biases canopy element 82, and thus mounting device 60, into appropriate engagement against ceiling 140, thereby taking up the "slop" within a given range of dimensional error in installation of junction box 64 in ceiling 140. In FIG. 21, where edges of junction box 64 extend outside edges of ceiling 140, resilient tabs 142 are less compressed than is ordinary so that a range of dimensional error that occurs when edges of junction box 64 extend from ceiling 140 is accommodated.

Additional embodiments, other than those shown in the drawings, according to this invention are described below. Connective structure, such as that carried by body 92 of mounting device 60, may be formed as part of an exit sign, such as exit sign 62, or the like. In such a configuration, a simple plate corresponding to plate 86 of connector 84 may have apertures that receive the connective structure carried by exit sign 62. In other words, the male portion of such an arrangement would be carried by exit sign 62 while the female portion would be located on a plate corresponding to plate 86, such a plate being attachable to a junction box such as junction box 64.

The foregoing description of the exemplary embodiments of the invention has been presented only for the purposes of illustration and description and is not intended to be exhaustive or to limit the invention to the precise forms disclosed. Many modifications and variations are possible in light of the above teaching. The embodiments were chosen and described in order to explain the principles of the invention and their practical application so as to enable others skilled in the art to utilize the invention and various embodiments and with various modifications, as are suited to the particular use contemplated. Alternative embodiments will become apparent to those skilled in the art to which the present invention pertains without departing from its spirit and scope.

What is claimed is:

1. A mounting device for connecting an electrical fixture to a junction box that is mounted to a wall or ceiling surface, the mounting device comprising:

a canopy element that covers the junction box upon connection of the mounting device to the junction box;

a connector that connects to the electrical fixture and is disposed between the canopy element and the junction box, the connector comprising at least one hook receivable within an opening in the electrical fixture;

a locking pin with a camming surface that engages with a surface of the at least one hook of the connector to secure the mounting device to the electrical fixture; and a universal mounting plate integrally formed with the connector that connects to the junction box.

2. The mounting device of claim 1, wherein the electrical fixture comprises an exit sign.

3. The mounting device of claim 1, wherein the universal mounting plate includes a plurality of apertures patterned to correspond to apertures in the junction box.

4. The mounting device of claim 3, further comprising at least one fastener that extends through at least one of the plurality of apertures in the universal mounting plate and a corresponding aperture in the junction box.

5. The mounting device of claim 4, wherein the at least one fastener comprises two screws.

6. The mounting device of claim 1, wherein the connector further comprises at least one redundance member that retains the connector in connection with the electrical fixture during assembly of the electrical fixture and connector.

7. The mounting device of claim 6, wherein the at least one redundance member includes structure for snap-fitting to surfaces disposed about the opening in the electrical fixture.

8. The mounting device of claim 1, wherein the junction box is mounted flush with the wall or ceiling surface.

9. The mounting device of claim 1, wherein the junction box is completely recessed within the wall or ceiling.

10. The mounting device of claim 1, wherein at least one edge of the junction box extends outside the wall or ceiling surface.

11. The mounting device of claim 1, wherein:

the connector has a plurality of circumferential ridges; and the canopy element includes an opening and is positionable relative to the wall or ceiling surface by engagement between a peripheral edge of the opening of the canopy element and any one of the plurality of circumferential ridges of the connector.

12. The mounting device of claim 1, wherein the canopy element is secured without any screws engaging or passing through the canopy element.

13. The mounting device of claim 1, wherein the connector further comprises:

flexible tabs that bias against opposing surfaces of the electrical fixture upon attachment of the electrical fixture to the connector to position the canopy element flush against the wall or ceiling surface.

14. A mounting device for connecting an electrical fixture to a junction box that is mounted to a wall or ceiling surface, the mounting device comprising:

a canopy element that covers the junction box upon connection of the mounting device to the junction box;

a connector that connects to the electrical fixture, wherein:

(i) the canopy element is disposed between the connector and the electrical fixture;

(ii) the connector includes flexible tabs that bias against opposing surfaces of the electrical fixture upon attachment of the electrical fixture to the connector to position the canopy element flush against the wall or ceiling surface; and a universal mounting plate integrally formed with the connector that connects to the junction box.

15. The mounting device of claim 14, wherein the connector includes at least one hook receivable within an opening in the electrical fixture and the mounting device further comprises a locking pin with a camming surface that engages with a surface of the at least one hook of the connector to secure the mounting device to the electrical fixture.

16. A lighting fixture that connects to a junction box that is mounted to a wall or ceiling surface, the lighting fixture comprising:

a housing that includes indicia and at least one illumination source that illuminates the indicia; and a mounting device for connecting the housing to the junction box, the mounting device including:

a canopy element that covers the junction box upon connection of the mounting device to the junction box;

a connector that connects to the housing and is disposed between the canopy element and the junction box, the connector comprising flexible tabs that bias against opposing surfaces of the housing upon attachment of the housing to the connector to position the canopy element flush against the wall or ceiling surface; and a universal mounting plate integrally formed with the connector that connects to the junction box.

17. The lighting fixture of claim 16, wherein the connector further comprises at least one hook receivable within an opening in the housing.

18. The lighting fixture of claim 16, further comprising a locking pin that engages a portion of the connector to secure the mounting device to the housing.

19. The lighting fixture of claim 16, wherein the canopy element is secured without any screws engaging or passing through the canopy element.

20. A lighting fixture that connects to a junction box that is mounted to a wall or ceiling surface, the lighting fixture comprising:

a housing that includes indicia and at least one illumination source that illuminates the indicia; and a mounting device for connecting the housing to the junction box, the mounting device including:

a canopy element that covers the junction box upon connection of the mounting device to the junction box;

a connector that connects to the housing and is disposed between the canopy element and the junction box, the connector comprising at least one hook receivable within an opening in the housing;

a locking pin with a camming surface that engages with a surface of the at least one hook of the connector to secure the mounting device to the housing; and a universal mounting plate integrally formed with the connector that connects to the junction box.

21. The lighting fixture of claim 20, wherein:

the connector has a plurality of circumferential ridges; and the canopy element includes an opening and is positionable relative to the wall or ceiling surface by engagement between a peripheral edge of the opening of the canopy element and any one of the plurality of circumferential ridges of the connector.

22. The lighting fixture of claim 20, wherein the connector further comprises at least one redundance member that retains the connector in connection with the housing during assembly of the housing and connector.

23. The lighting fixture of claim 22, wherein the at least one redundance member includes structure for snap-fitting to surfaces disposed about the opening in the housing.

24. The lighting fixture of claim 20, wherein the connector further comprises:

flexible tabs that bias against opposing surfaces of the housing upon attachment of the housing to the connector to position the canopy element flush against the wall or ceiling surface.

25. The lighting fixture of claim 20, wherein the universal mounting plate includes a plurality of apertures patterned to correspond to apertures in the junction box.

* * * * *